US005348557A

United States Patent [19]

von der Eltz et al.

[11] Patent Number: 5,348,557

[45] Date of Patent: Sep. 20, 1994

[54] PRODUCTION OF DYEINGS BY THE INKJET PRINTING TECHNIQUE ON MODIFIED FIBER MATERIALS USING ANIONIC TEXTILE DYES

[75] Inventors: Andreas von der Eltz; Andreas Schrell, both of Frankfurt am Main; Werner H. Russ, Flösheim am Main, all of Fed. Rep. of Germany

[73] Assignee: Hoechst Aktiengesellschaft, Frankfurt am Main, Fed. Rep. of Germany

[21] Appl. No.: 125,939

[22] Filed: Sep. 23, 1993

[30] Foreign Application Priority Data

Sep. 26, 1992 [DE] Fed. Rep. of Germany ..... 4232331

[51] Int. Cl.[5] ..... D06P 1/39; D06P 1/38; D06M 13/342; D06M 13/35

[52] U.S. Cl. ..... 8/188; 8/181; 8/189; 8/565; 8/574

[58] Field of Search ..... 8/181, 188, 189, 196, 8/172, 543, 565–574, 576, 918; 428/266, 429, 451

[56] References Cited

U.S. PATENT DOCUMENTS

| | | | |
|---|---|---|---|
| 3,653,952 | 4/1972 | Gagliardi | 428/266 |
| 3,892,527 | 7/1975 | Tamer et al. | 8/172 |
| 4,775,384 | 10/1988 | Bachem et al. | 8/181 X |
| 4,889,923 | 12/1989 | Mischke et al. | 8/532 X |

FOREIGN PATENT DOCUMENTS

| | | |
|---|---|---|
| 0513656 | 11/1992 | European Pat. Off. . |
| 0546476 | 6/1993 | European Pat. Off. . |
| 1294236 | 4/1961 | France . |
| 2226504 | 4/1974 | France . |
| 63-68680 | 3/1988 | Japan . |
| 63-85188 | 4/1988 | Japan . |
| 3-205179 | 9/1991 | Japan . |
| 479341 | 2/1938 | United Kingdom . |
| 1463682 | 2/1977 | United Kingdom . |

OTHER PUBLICATIONS

Methoden der Organischen Chemie (Houbey-Weyl) Band VI/2, 1963, pp. 452–457.

Organische Schwefel-Verbindugen, Band E-11, 1985, pp. 997–1004.

Kohlensäure-Derivate, Hermann Hagemann, Band E4, 1983, pp. 82–194.

Journal of Applied Polymer Science, vol. 21, (1977), Grafting of Cylic Carbonates onto Cotton and Modified Cottons, pp. 1933–1944.

Smith, B., et al., *Textile Chemist and Colorist 19*: No. 8, pp. 23–29 (1987).

Graham, L. A., *Textile Chemist and Colorist 21*: No. 6, pp. 27–32 (1989).

*Primary Examiner*—Arthur C. Prescott

[57] ABSTRACT

There is described a process for dyeing sheetlike fiber materials, in particular those made of or containing cellulose fibers, with anionic dyes, in particular those having fiber-reactive groups, which comprises applying an alkali-free and preferably low-electrolyte or completely electrolyte-free aqueous solution of the anionic dye by the inkjet printing spray technique to a fiber material which has been pretreated and modified with a compound that contains one or more primary, secondary or tertiary amino groups or quaternary ammonium groups, which amino/ammonium groups may be part of a heterocycle. There is generally no need for an after-treatment by washing. The costly treatment of wastewaters resulting from the excess dyeing liquors otherwise obtained is eliminated. If fiber-reactive dyes are used, fixation by means of alkali is not necessary; it is generally effected by a short heat treatment.

8 Claims, No Drawings

PRODUCTION OF DYEINGS BY THE INKJET PRINTING TECHNIQUE ON MODIFIED FIBER MATERIALS USING ANIONIC TEXTILE DYES

DESCRIPTION

Cellulose fiber textile materials such as woven fabrics, knitted fabrics, yarns and nonwovens are dyeable with anionic dyes by known methods. Of late this has come to mean not only by the conventional dyeing methods of printing, exhaust dyeing and padding but also by a modern spray technique which was first applied to paper under the name of inkjet printing but has recently also come to be used on textile materials. It is a common feature of all the methods that alkali is required for fixing the dye on the fiber, in particular in the case of dyeing with reactive dyes. The alkali is added to the dyeing process before, after or during the application of the dye to the fiber material; after fixation, however, costly washing processes have to be employed to remove the alkali together with dye hydrolyzates. Especially the dye hydrolyzates formed in conventional processes will, if having inadequate washoff properties, cause severe staining or at least a blurring of crisp contours.

The inkier printing process is the only one of the non contact printing processes which makes it possible to produce colored images rapidly, quietly and in high resolution. The process is usually carried out with aqueous inks, which are sprayed as small droplets directly onto the substrate. There is a continuous form of the process, in which the ink is pressed at a uniform rate through a nozzle and the Jet is deflected onto the paper, or into an ink collector, by an electric field depending on the pattern to be printed, and there is an interrupted inkjet or drop-on-demand process, in which the ink is expelled only where a colored dot is to appear, the latter form of the process employing a piezoelectric crystal or a heated hollow needle (bubble or thermal Jet process) to exert pressure on the ink system and so eject an ink droplet. These techniques are described in Text. Chem. Color. 19 (8), 23–29, and 21 (6), 27–32.

It is also known that by adding alkali donors, for example haloacetates, and subsequent steaming it is even possible to use reactive dyes to dye by the inkier process (cf. for example Japanese Patent Application Publications sho-63-068680 and hei-3-205179). Furthermore, it is known from Japanese Patent Application Publication sho-63-085188 to coat a textile material with a cationic polymer and then to dye it with anionic dyes by inkjet printing. This process does not produce a covalent bond, as is obtained when reactive dyes are used, but the characteristics of the substrate are decisively modified by the coat of polymer.

The present invention, then, provides a process for dyeing sheetlike fiber materials, in particular those made of or containing cellulose fibers, with anionic dyes, in particular those having fiber reactive groups, in brilliant, light and deep shades with good color strength and excellent contour crispness, which comprises applying an alkali-free and preferably low-electrolyte or completely electrolyte-free aqueous solution of the dye by the inkjet printing spray technique (to be understood as including all minimum add-on spraying techniques) to a fiber material which has been pretreated and modified with a compound that contains one or more, such as 2 or 3, primary, secondary or tertiary amino groups or quaternary ammonium groups, which amino/ammonium groups may be part of a heterocycle.

These compounds are in particular compounds conforming to the formulae (1), (2), (3a ), (3b) and (4)

$$H_2N-(CH_2)_k-OSO_3M \quad (1)$$

(2)

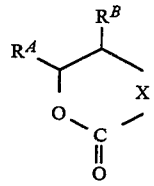

(3a)

$$A \qquad N-\text{alkylen}-(ER)_m$$

$$(B)_p-\underset{(OH)_n}{\underset{|}{\text{alk}}}-(ER)_m \quad (3b)$$

(4)

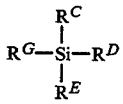

where

M is a hydrogen atom or an alkali metal, such as sodium, potassium or lithium, k is 1 or 2, preferably 2, $R^A$ is hydrogen or alkyl of 1 to 3 carbon atoms which may be substituted by hydroxy or a group of the formula (5a) or (5b)

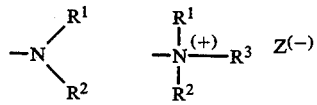

(5a) (5b)

where $R^1$ is hydrogen, methyl or ethyl, $R^2$ is hydrogen, methyl or ethyl, and $R^3$ is hydrogen, methyl or ethyl, or Rand $R^2$ together with the nitrogen atom are a saturated heterocyclic radical formed from an alkylene radical of 5 to 8 carbon atoms or two alkylene radicals of 1 to 4 carbon atoms and an oxygen atom or an amino group of the formula —NH—, for example N-piperazino, N-piperidino or N-morpholino, and $Z^{(-)}$ is a monovalent anion, for example the chloride or hydrogensulfate anion, or a part, equivalent to a monvalent anion, of a polyvalent anion such as the sulfate anion, $R^B$ has one of the meanings specified for $R^A$, and X is —O— or —NH—, ER is an ester group, A and N together with 1 or 2 alkylene groups of 1 to 4 carbon atoms form the bivalent radical of a heterocyclic ring, preferably a 5 or 6-membered heterocyclic ring, for ex. of the piperazine, piperidine or morpholine ring, in which A is an oxygen atom or a group of the formula (a), (b) or (c)

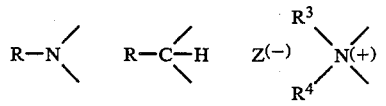

(a) (b) (c)

where

R is a hydrogen atom, an amino group, an alkyl group of 1 to 6, preferably 1 to 4, carbon atoms which may be substituted by 1 or 2 substituents selected from the group consisting of amino, sulfo, hydroxy, sulfato, phosphato and carboxy, or an alkyl group of 3 to 8, preferably 3 to 5, carbon atoms which is interrupted by 1 or 2 hetero groups selected from —O— and —NH— and may be substituted by an amino, sulfo, hydroxy, sulfato or carboxy group, $R^3$ is hydrogen, methyl or ethyl, $R^4$ is hydrogen, methyl or ethyl, and $Z^{(-)}$ is as defined above, is an amino group of the formula $H_2N$— or an amino or ammonium group of the formula (d) or (e)

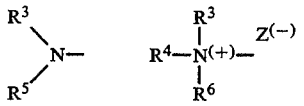

(d) (e)

in which $R^3$, $R^4$ and $Z^{(-)}$ are each as defined above, $R^5$ is methyl or ethyl, and $R^6$ is hydrogen, methyl or ethyl, p is 1 or 2, preferably 1, alkylen is a straight-chain or branched alkylene radical of 2 to 6, preferably 2 to 4, carbon atoms which may be substituted by 1 or 2 hydroxy groups, or a straight-chain or branched alkylene radical of 3 to 8, preferably 3 to 5, carbon atoms which is interrupted by 1 or 2 hereto groups selected from —O— and —NH—, alk is a straight-chain or branched alkylene radical of 2 to 6, preferably 2 to 4, carbon atoms or a straight-chain or branched, preferably straight chain alkylene radical of 3 to 8, preferably 3 to 5, carbon atoms which is interrupted by 1 or 2 hereto groups selected from —O— and —NH—, and preferably is a straight-chain or branched alkylene radical of 2 to 6, preferably 2 to 4, carbon atoms, m is 1 or 2, preferably 1, n is from 1 to 4, preferably 1 or 2, and the amino, hydroxy and ester groups in the compounds (3a) and (3b) can be attached to a primary, secondary or tertiary carbon atom of the alkylene radical, $R^C$ is hydrogen, alkoxy of 1 to 8, preferably 1 to 4, carbon atoms, such as methoxy, ethoxy or propoxy halogen, such as chlorine or bromine, hydroxy, alkoxy of 2 to 4 carbon atoms, preferably ethoxy, with alkoxy of 1 to 4 carbon atoms as substituent, N-morpholino, N-imidazolino or a group of the formula (6)

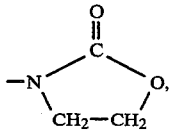

(6)

$R^D$ is a group of the formula (7a) or (7b)

$$\text{-}[D-X^1]_a-\{[E-X^2]_b G-T\}_c \quad (7a)$$

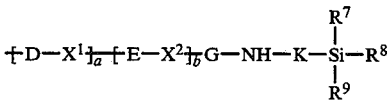

(7b)

where a is zero of 1, b is an integer from zero to 10, preferably zero of 1 to 5 and in particular zero or 1 to 3, c is 1 or 2, c =1 being mandatory when a is zero, the sum (a+b) is preferably equal to or greater than 1, particularly preferably 1, 2, 3 or 4

$R^7$ has one of the meanings of $R^C$, $R^8$ is alkoxy of 1 to 8, preferably 1 to 4, carbon atoms, such as ethoxy or methoxy, with or without alkoxy of 1 to 4 carbon atoms as substituent, alkyl of 1 to 8, preferably 1 to 4, carbon atoms, such as ethyl or methyl, alkenyl of 2 to 8, preferably 2 to 4, carbon atoms or phenylenealkyl where the alkyl radical has 1 to 4 carbon atoms and the phenylene radical may be substituted by substituents selected from the group consisting of methyl, ethyl, methoxy, ethoxy, sulfo and carboxy, each of which radicals $R^8$ may be additionally substituted by a group T of the above meaning, $R^9$ has one of the meanings of $R^C$ or $R^E$, D is alkylene of 1 to 6, preferably 2 to 4, carbon atoms which may be substituted by hydroxy, methoxy, ethoxy, sulfo, sulfato or carboxy, or is phenylene which may be substituted by methoxy, ethoxy, methyl, ethyl, sulfo and/or carboxy, or is phenylenealkylene, alkylenephenylene, alkylenephenylenealkylene or phenylenealkylenephenylene, in each of which the alkylene group or groups has or have from 1 to 6, preferably 1 to 4, carbon atoms and may be substituted by hydroxy, methoxy, ethoxy, sulfo, sulfato or carboxy and the phenylene radicals may be substituted by methoxy, ethoxy, methyl, ethyl, sulfo and/or carboxy, $X^1$ is for c=1 a group of the formula —S—, —O—, —NH— or —N(R)—, R being alkyl of 1 to 4 carbon atoms, such as methyl or ethyl, and is preferably a group of the formula —O— or —NH—, or for c=2 is a nitrogen atom, E is cycloalkylene of 5 to 8 carbon atoms, such as cyclohexylene and cyclopentylene, or alkylene of 1 to 6, preferably 1 to 4 and in particular 2 or 3, carbon atoms which may be substituted by hydroxy, methoxy, ethoxy, sulfato, sulfo or carboxy, or is phenylene which may be substituted by methoxy, ethoxy, methyl, ethyl, sulfo and/or carboxy , preferably alkylene of 2 to 4 carbon atoms, $X^2$ is a group of the formula —S—, —O—, —NH— or —N(R)— where R is as defined above, and preferably —O— or —NH—, G is alkylene of 1 to 6, preferably 2 to 4, carbon atoms which may be substituted by hydroxy, methoxy, ethoxy, sulfo, sulfato or carboxy, or is phenylene which may be substituted by methoxy, ethoxy, methyl, ethyl, sulfo and/or carboxy, or is phenylenealkylene, alkylenephenylene, alkylenephenylenealkylene or phenylene alkylenephenylene, in each of which the alkyl group or groups has or have from 1 to 6, preferably from 1 to 4, carbon atoms and may be substituted by hydroxy, methoxy, ethoxy, sulfo, sulfato or carboxy and the phenylene radical or radicals may be substituted by methoxy, ethoxy, methyl, ethyl, sulfo and/or carboxy, or G can be a direct bond if (a+b) is not zero, and is preferably alkylene of 2 to 4 carbon atoms or a direct bond if (a+b) is equal to or greater than 1, T is hydroxy, thiol or preferably a group of the formula (8a) or (8b), particularly the formula (8a)

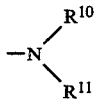

(8a)

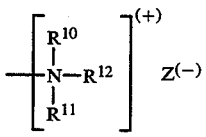

(8b)

where $R^{10}$ is hydrogen or alkyl of 1 to 4 carbon atoms which may be substituted by phenyl, sulfophenyl, amino, thio or hydroxy, or is carbamoyl, which may be mono- or disubstituted, for example by substituents from the group consisting of alkyl of 1 to 4 carbon atoms, phenyl, sulfophenyl, cycloalkyl of 5 to 8 carbon atoms and alkyl of 2 to 4 carbon atoms, which is amino-, thio- or hydroxy -substituted, $R^{11}$ is hydrogen, phenyl, sulfophenyl or alkyl of 1 to 4 carbon atoms which may be substituted by phenyl, sulfophenyl, methoxy, ethoxy, amino, thio or hydroxy, $R^{12}$ is hydrogen, alkyl of 1 to 4 carbon atoms which may be substituted by for example hydroxy, amino, thio, carboxy or sulfo, or alkenyl of 2 to 6, preferably 2 to 4, carbon atoms, and $Z^{(-)}$ is as defined above, K is a radical of the formula (9)

$$-G\text{-}X^2-E\text{-}_b\text{-}X^1-D\text{-}_a \quad (9)$$

where G, $X^2$, E, $X^1$, D, a and b have the above, in particular the preferred, definitions, $R^E$ is hydrogen, alkoxy of 1 to 8, preferably 1 to 4, such as propoxy ethoxy and methoxy, carbon atoms with or without alkoxy of 1 to 4 carbon atoms as substituent, halogen, such as chlorine or bromine, hydroxy, alkyl of 1 to 8, preferably 1 to 4, carbon atoms, such as ethyl and methyl, alkenyl of 2 to 8, preferably 2 to 4, carbon atoms, alkinyl of 3 to 8, preferably 3 to 5, carbon atoms or phenyl or a group of the formula (7a) or (7b), preferably alkyl of 1 to 4 carbon atoms, alkoxy of 1 to 4 carbon atoms, alkoxy of 2 to 4 carbon atoms substituted by alkoxy of 1 to 4 carbon atoms, or a group of the formula (7a) or (7b), $R^G$ has one of the meanings mentioned for $R^C$ or $R^E$, and at least one of the substituents attached to the silicon atom is a hydrolyzable substituent selected from the group consisting of hydrogen, halogen, alkoxy, phenoxy, amino and amido, for example those mentioned at the beginning for $R^C$, of which alkoxy radicals are preferred.

The radical of the formula (9) and the radical of the formula $-[D-X^1]_a-[E-X^2]_b-G-$ corresponding to it in the formula (7a) is preferably a radical of the formula (10a), (10b), (10c), (10d), (10e), (10f), (10g), (10h), (10i) or (10j), preferably of the formula (10c), (10d), (10e), (10f), (10h), (10i)or (10j):

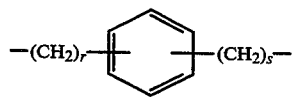

(10a)

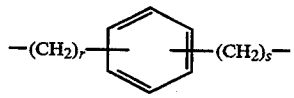

(10b)

$-(CH_2)_r-O-(CH_2)_s-$ (10c)

$-(CH_2)_r-O-(CH_2)_s-CH(OH)-CH_2-$ (10d)

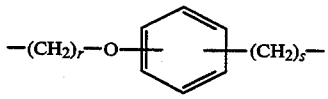

(10e)

$-(CH_2)_r-NH-(CH_2)_s-$ (10f)

$-(CH_2)_r-S-(CH_2)_s-$ (10g)

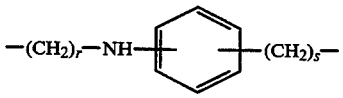

(10h)

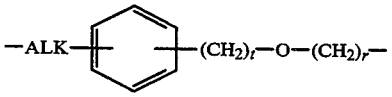

(10i)

$-(CH_2)_r\text{-}O-(CH_2)_v\text{-}_z$ (10j)

where r is an integer from 1 to 6, preferably from 2 to 4, s is an integer from zero to 6, preferably from 1 to 4, t is an integer from zero to 4, preferably 1 or 2, t is an integer from zero to 4, preferably 2 or 3, z is an integer from 1 to 10, preferably from 1 to 5, in particular 1, and ALK is a straight-chain or branched alkylene radical of 1 to 8 carbon atoms, the branched alkylene preferably having the formula

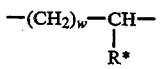

where w is an integer from 1 to 4 and R* is alkyl of 1 to 3 carbon atoms.

$R^{10}$ is preferably hydrogen, alkyl of 1 to 3 carbon atoms, such as methyl or ethyl, or cyclohexyl, particularly preferably hydrogen, methyl or ethyl, particularly hydrogen. $R^{11}$ is preferably hydrogen, alk of 1 to 4 carbon atoms, in particular methyl or ethyl, phenyl or alkyl of 2 to 4 carbon atoms which is substituted by methoxy or ethoxy, less preferably hydrogen. Preferably the group of the formula (8a) is a secondary amino group, in particular methylamino or ethylamino.

Preferably only one of the radicals $R^A$ and $R^B$ is an alkyl group containing a group of the formula (5a) or (5b).

The alkyl, alkenyl and alkylene radicals mentioned for the above symbols can be straight-chain or branched. The meanings of the individual symbols can be identical to or different from each other within the scope of their given meaning.

Examples of compounds (1), (2), (3a) and (3b) usable according to the invention are β-sulfatoethylamine, 2-oxo-1,3-oxazolidine, 4-aminomethyl-2-oxo-1,3-oxazolidine, 5-aminomethyl-2-oxo-1,3-oxazolidine, 4-(trimethylammoniomethyl)-2-oxo-1,3-oxazolidine chloride, 5-(trimethylammoniomethyl)-2-oxo-1,3-oxazolidine chloride, 1-(trimethylammoniomethyl)ethylene carbonate chloride, N-(β-sulfatoethyl)piperazine, N-[β-(β'-sulfatoethoxy)ethyl]piperazine, N-(γ-sulfato-β-hydroxypropyl)piperidine, N-(γ-sulfato--hydroxypropyl)pyrrolidine, N-(β-sulfatoethyl)piperidine, the salts of 3-sulfato-2-hydroxy-1-(trimethylammonium)propane, such as 3-sulfato-2-hydroxy-1-(trimethylammonium)propane sulfate, 2-sulfato-3-hydroxy-1-aminopropane, 3-sulfato-2-hydroxy-1-aminopropane, 1-sulfato-3-hydroxy-2-aminopropane, 3-hydroxy-1-sulfato-2-aminopropane, 2,3-disulfato-1-aminopropane and 1,3-disulfato-2-aminopropane and also derivatives of these compounds with an ester group other than sulfato, as with a phosphato group, an alkanoyloxy group of 2 to 5 carbon atoms, such as acetyloxy, p-tosyloxy or 3,4,5-trimethylphenylsulfonyloxy.

Of the usable silane compounds of the formula (4) according to the invention, attention is drawn in particular to those which contain a secondary amino group and conform to the formula (11)

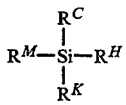

(11)

where $R^C$ is as defined above, $R^H$ is a group of the formula (12a) or (12b)

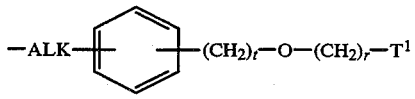

(12a)

$$-(CH_2)_r\text{+}O-(CH_2)_v\text{+}_z T^1 \quad (12b)$$

where r is an integer from 1 to 6, preferably from 2 to 4, t is an integer from zero to 4, preferably 1 or 2, v is an integer from 1 to 4, preferably 2 or 3, z is an integer from 1 to 10, preferably from 1 to 5, in particular 1, and ALK is a straight-chain or branched alkylene radical of 1 to 8 carbon atoms, branched alkylene preferably having the formula

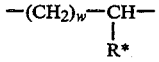

where w is an integer from 1 to 4 and R* is alkyl of 1 to 3 carbon atoms, and is an amino group of the formula (8c)

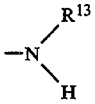

(8c)

where $R^{13}$ is hydrogen or alkyl of 1 to 4 carbon atoms which may be substituted by phenyl, sulfophenyl, amino, thio or hydroxy, or is carbamoyl, which may be mono- or disubstituted, for example by substituents from the group consisting of alkyl of 1 to 4 carbon atoms, phenyl, sulfophenyl, cycloalkyl of 5 to 8 carbon atoms and alkyl of 2 to 4 carbon atoms, which is amino-, thio- or hydroxy -substituted, and preferably alkyl of 1 to 4 carbon atoms, such as methyl or ethyl, $R^K$ is hydrogen, alkoxy of 1 to 8 carbon atoms, preferably of 1 to 4 carbon atoms, such as propoxy, ethoxy or methoxy, with or without alkoxy of 1 to 4 carbon atoms as substituent, halogen, such as chlorine or bromine, hydroxy, alkyl of 1 to 8 carbon atoms, preferably of 1 to 4 carbon atoms, such as ethyl or methyl, alkenyl of 2 to 8 carbon atoms, preferably of 2 to 4 carbon atoms, alkinyl of 3 to 8 carbon atoms, preferably of 3 to 5 carbon atoms, or phenyl or a group of the formula (12a) or (12b), preferably alkyl of 1 to 4 carbon atoms, alkoxy of 1 to 4 carbon atoms, alkoxy of 2 to 4 carbon atoms that is substituted by alkoxy of 1 to 4 carbon atoms, or a group of the formula (12a) or (12b), and $R^M$ has one of the meanings mentioned for $R^C$ and $R^x$.

Examples of usable silane compounds of the formula (4) according to the invention are: [γ-(β'-aminoethoxy)-propyl]trimethoxysilane, [γ-(β'-aminoethylamino)-propyl]trimethoxysilane, [γ-(β'-aminoethoxy)propyl]-methyldiethoxysilane, [γ-(β'-aminoethylamino)propyl]-methyldimethoxysilane, 3- or 4-aminophenyltrimethoxysilane, [γ-(4-aminophenoxy)propyl]trimethoxysilane, N-[γ-(trimethoxysilyl)propyl]-N,N-di(β'-aminoethyl)amine, [γ-(aminopropyl)trimethoxysilane, (γ-aminopropyl)ethoxydimethylsilane, (γ-aminopropyl)methyldiethoxysilane, N,N-bis[γ-(triethoxysilyl)propyl]amine, [γ-(N,N-dimethylamino)propyl]trimethoxysilane, [γ-(N-methylamino)propyl]trimethoxysilane, (δ-aminobutyl)trimethoxysilane, {4-[N-(β-aminoethyl-)amino]methyl}phenethyltrimethoxysilane, [(N-cyclohexylamino)methyl]methyldiethoxysilane, [γ-(N,N-diethylamino)propyl trimethoxysilane, [γ-(β'-N-methylaminoethoxy) propyl]methyldiethoxysilane, [γ-(β'-N-methylaminoethoxy) propyl]triethoxysilane, [γ-(β'-N-methylaminoethoxy ) propyl]dimethylethoxysilane, 1-{3'-[-(N-methylamino)ethoxymethyl]-phenyl}eth-1-yl(diethoxy)(methyl)silane, 2-{4'-[-(N-methylamino)ethoxymethyl]phenyl}eth-2-yl(diethoxy)(methyl)silane, 1-{4'-[-(N-methylamino)ethoxymethyl]phenyl}eth-1-yl(diethoxy)(methyl)silane, 2-{3'-[-(N-methylamino)ethoxymethyl]phenyl}eth-2-yl(diethoxy)(methyl)silane, {y-[β40 -(β''-aminoethyl)aminoethyl]propyl}trimethoxysilane and 1,3-di(γ-aminopropyl)propyl)-1,1,3,3-tetramethyldisiloxane.

The usable compounds (1) and (2) according to the invention can be prepared by known methods, as described numerously in the literature (see Houben-Weyl, Methoden der Organischen Chemie, 4th edition, volume E4, pages 82–88 and 192 ff.), for example by reacting an alkanediol which has a latent nitrogen-containing functional group in the side chain with phosgene in aqueous solution at a pH between 7 and 9 to form the hetero-cycloaliphatic carbonates or for example by reacting aminoalkanols with phosgene in aqueous solution to produce the heretocycloaliphatic carbamic acid compounds (2-oxo-1,3-oxazolidines).

The usable compounds (3a) and (3b) according to the invention can be prepared by esterifying their corresponding hydroxy -containing compounds in a conventional manner by reaction with the acids or the corresponding acylating agents, although if the starting material used is an amino-containing compound having more than one hydroxy group, preferably only one of these hydroxy groups is esterified. Procedures of this type are described in the literature; the preparation of the usable compounds according to the invention can be carried out similarly to such known procedures. For instance, Houben-Weyl, Methoden der Organischen Chemie, volume VI/2, pages 452–457, and volume E11, pages 997 ff., describes the esterification of aminoalcohols to form the sulfuric esters thereof. Further common modifications of such procedures are based for example on stirring the aminoalcohol into a large excess of fuming sulfuric acid (see Chem. Bet. 51, 1160) or on using inert solvents as the reaction medium for the esterification, in which case the use of equimolar amounts of concentrated sulfuric acid is possible (see DE-C-825 841). Esterifying and acylating agents which can be used as starting compounds for preparing the usable ester- and amino-containing compounds according to the invention are for example sulfuric acid, phosphoric acid, polyphosphoric acid, lower alkanecarboxylic acids and their chlorides or anhydrides, for example acetic acid (glacial acetic acid) and acetic anhydride, benzenesulfonic acid and the benzenesulfonic acids which are substituted in the benzene ring by substituents from the group consisting of sulfo, carboxy, lower alkyl, lower alkoxy and nitro, or sulfochlorides thereof. For example, the sulfato compounds can be prepared from the corresponding hydroxy compounds by introducing the hydroxy compounds into the required amount, i.e. preferably equimolar amount, of concentrated sulfuric acid and stirring at a temperature between 5 and 30° C. for some time until completely dissolved. They are isolated from the sulfuric acid solution by pouring the solution onto ice and neutralizing, by precipitating the sulfate ions by means of calcium carbonate as calcium sulfate and subsequent filtration and evaporation of the aqueous solution. The sulfato compounds, for example, are crystalline or semicrystalline substances which can be used directly in the process for modifying the fiber material.

A large number of the silane compounds used according to the invention have been described in the literature and some are commercially available. Silane compounds which have not been described before can be synthesized on the lines of the procedures for preparing the known silane compounds, for example as described in German Patent No. 1,186,061.

More particularly, the silane compounds of the formula (11), for example, can be prepared by reacting a compound of the formula (13)

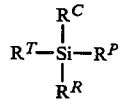

(13)

where $R^C$ is as defined above, is a radical of the formula (14a) or (14b)

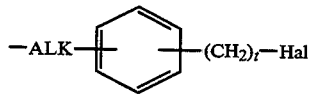

(14a)

$-(CH_2)_r-Hal$ (14b)

where

ALK, t and r are each as defined above,

Hal is a halogen atom, preferably a chlorine atom,

Ris hydrogen, alkoxy of 1 to 8 carbon atoms, preferably of 1 to 4 carbon atoms, such as propoxy, ethoxy or methoxy, with or without alkoxy of 1 to 4 carbon atoms as substituent, halogen, such as chlorine or bromine, hydroxy, alkyl of 1 to 8 carbon atoms, preferably of 1 to 4 carbon atoms, such as ethyl or methyl, alkenyl of 2 to 8 carbon atoms, preferably of 2 to 4 carbon atoms, alkinyl of 3 to 8 carbon atoms, preferably of 3 to 5 carbon atoms or phenyl or a group of the formula (14a) or (14b), preferably alkyl of 1 to 4 carbon atoms, alkoxy of 1 to 4 carbon atoms, alkoxy of 2 to 4 carbon atoms which is substituted by alkoxy of 1 to 4 carbon atoms, or a group of the formula (14a) or (14b), and $R^T$ has one of the meanings mentioned for $R^C$ or $R^R$, with a compound of the formula (15a ) or (15b)

$$MeO-(CH_2)_r-T^1 \quad (15a)$$

$$MeO-(CH_2)_v-T^1 \quad (15b)$$

where r, v and Tare each as defined above and Me is an alkali metal, such as sodium or in particular potassium, in a polar, organic, water-miscible or -immiscible solvent which is inert toward the reactants, in particular to alcoholates, at a temperature between 0 and 50° C., preferably between 10 and 40° C.

The starting compounds of the formulae (15a ) and (15b) are prepared in a conventional manner by starting from the corresponding hydroxy compound (an aminoalcohol) and reacting it in a conventional manner with the metallic alkali metal, such as sodium and in particular potassium, in the abovementioned solvents. In general, the reaction is carried out at a temperature between 50 and 150° C., preferably between 80 and 110° C. The solvent used advantageously has a sufficiently high boiling point for the alkali metal to be heated to above its melting point in order that the reaction may be simplified and speeded up.

Suitable solvents for this purpose are in particular aliphatic hydrocarbons having a boiling range from 70 to 150° C., for example heptane and dodecane, and mixtures thereof, also aromatic hydrocarbons, for example alkyl-substituted benzenes and naphthalenes, in particular toluene and xylene, and also aliphatic, in particular cycloaliphatic, ether compounds, for example tetrahydrofuran.

The reaction of the compounds of the formula (13) with a compound of the formula (15a) or (15b) liberates the corresponding alkali metal halide and precipitates it as a crystalline salt. The salt is separated off after the reaction, for example by filtration, and the remainder is subjected to a fractional distillation to remove the solvent and isolate the synthesized silane compound.

Fiber materials for the purposes of the present invention are natural and synthetic fiber materials that contain hydroxy and/or carboxamide groups, such as silk, wool and other animal hairs and also synthetic polyamide fiber materials and polyurethane fiber materials, for example nylon-4, nylon-6 and nylon-11, and in particular fiber materials which contain the basic structure of $\alpha,\beta$-glucose, such as cellulose fiber materials, for example cotton, hemp, Jute and linen, and their regenerated derivatives, such as filament viscose and staple viscose, or mixtures of such fiber materials, subject to the proviso that the fiber material to be used in the present inkier dyeing process is in the form of a sheetlike structure (piece good), such as woven or knitted fabric.

Anionic dyes for the purposes of the present invention are dyes which contain anionic, i.e. acid, groups, such as sulfo and carboxy groups, and their salts, such as alkali metal salts, and are accordingly water-soluble. More particularly, the anionic dyes in question have a fiber-reactive group, i.e. a group which is usually able to react with the carboxamide or hydroxy groups of the fiber material to form a bond with them.

The modification of the fiber material with the amino-containing compounds, such as those of the formulae (1), (2), (3a), (3b) and/or (4), can be carried out for example by bringing the fiber material into contact with one of these compounds that can be used according to the invention, or with a mixture of such compounds, in an alkaline aqueous solution and allowing the amino-containing compound to act on the fiber material at a temperature between 60 and 230° C., preferably between 90 and 190° C. The concentration of this compound in the alkaline aqueous solution is in general between 1 and 20% by weight, preferably between 5 and 10% by weight. The alkali, for example sodium hydroxide, sodium carbonate or potassium carbonate, is present in the solution in a concentration between 0.1 and 20% by weight, preferably between 5 and 10% by weight. In general, this alkaline aqueous solution has a pH between 10 and 14.

The fiber material can be present in the course of the modification process as well in the modified form in the dyeing process of the invention in mixture with other fiber materials, for example in the form of cotton/-polyester fiber materials, and in the form of blend fabrics with other fiber materials.

The amino-containing compounds used for modification of the fiber material can be brought into contact with the fiber material in an alkaline aqueous solution in various ways, for example by treating the fiber material in an alkaline, aqueous solution of the amino-containing compound (similarly to an exhaust dyeing process) at a temperature between 15 and 100° C.—in which case, in particular at the higher temperatures, modification of the fiber material will be effected automatically. Other possibilities are to slop-pad, nip-pad or spray the fiber material with the aqueous, alkaline solution. If the impregnation of the fiber material with this alkaline, aqueous solution is effected by introducing the fiber material into this solution or by padding (slop-padding), the excess liquor is subsequently squeezed off the impregnated material to such an extent that the pickup by this fiber material of the aqueous, alkaline solution is between 50 and 120% by weight, preferably between 70 and 100% by weight, based on the fiber material. In general, impregnation (by slop-padding, nip-padding or treatment in the solution itself) is carried out at a temperature between 10 and 60° C., preferably at a temperature between 15 and 30° C. If the solution is applied to the fiber material by spraying, which in general is carried out at a temperature between 10 and 40° C., the wet pickup is preferably between 10 and 50% by weight.

If the fiber material is a mercerized cellulose fiber material, the amino-containing compounds usable according to the invention can with advantage also be applied to the cellulose fiber material immediately following the process of mercerization, at which stage the mercerized material still contains the alkali, for example by squeezing the mercerized, alkali-impregnated material if necessary to a required wet content and impregnating it with the aqueous solution of the amino-containing compound usable according to the invention by over-padding, spraying or a similar, conventional technique. After the fiber material has been impregnated by one of the various abovementioned techniques other than the pretreatment by an exhaust method, it is dried; in general, the drying step is also used to fix the fiber-modifying compound, the preferred temperature for the drying and fixing step being between 100 and 230° C., in particular between 120 and 190° C. In general, drying and simultaneous fixation is effected by treating with hot air for from 1 to 5 minutes. The fixing of the fiber-modifying compound to the fiber material can be effected by simply drying at elevated temperatures; for instance, the fiber material can be dried and have the modifying compound fixed to it by suspending it in drying cabinets and exposing it to the necessary elevated temperatures, for example 80 to 105° C.

The aftertreatment of the modified fiber material is effected by rinsing with cold and hot water and, if necessary, by treating in an aqueous bath, which contains a small amount of an acid, such as acetic acid, to remove the alkali from the fiber material and then drying. The fiber material used in the dyeing process should ideally have a neutral pH.

The application of the dye solutions to the modified fiber material (woven, knitted or nonwoven fabric) is effected with the aid of commercial inkjet printers, if necessary adapted for large-scale industrial purposes. Neutral, preferably aqueous solutions are used of the anionic dyes, and the anionic dyes preferably contain a fiber-reactive group. The dye solutions may contain assistants of the type usually present of necessity in the inks for inkier printers, for example antiaggregants, such as N-methylpyrrolidone, dimethylformamide and dimethylacetamide, and wetting agents, such as ionic or nonionic surfactants. The assistants normally required when dyeing with anionic, in particular fiber-reactive, dyes need not be used. In fact, their use would be inappropriate and disadvantageous. The anionic dyes are advantageously used free of electrolyte salts, such as sodium chloride and sodium sulfate. But even commercial dye preparations containing up to 50% by weight of electrolyte salt can in general be applied by the inkier printing/dyeing process of the invention without any problems. In the case of color printing, a plurality of ink cartridges can be connected in series, which are controllable by the present-day customary means for the purpose of creating the print on the moving sheet of material. It is also possible to use modern multichamber inkier cartridges, whereby a plurality of colors can be applied at the same time in a single pass.

The dye solution (ink) is applied to the modified material to be dyed in the manner expected of inkjet printing: specifically and in tiny droplets. The material dyed in this way is then subjected to a treatment with high-temperature steam, hot air or some other form of energy, such as irradiation with electromagnetic waves in the microwave or radiofrequency region, to fix the dyes to the modified fiber material. Especially because the amount of dye solution applied to the material by inkier printing is small, the dyed material does not in general have to be subjected to a subsequent wash treatment. The result is that the dyeing process can be carried out without pollution in the form of any wastewaters, which in the conventional dyeing processes contain for example unfixed dye, alkali and electrolyte salts, or in the form of other waste products. The process of the invention gives strong prints having the customary good fastness properties.

Different depths of shade in the same hue are very simple to obtain with the inkjet process, for instance by controlling the amount of dye solution applied, for example by repeatedly overprinting the same line, or else by breaking up the Jet and printing a fine pattern of dots which with present-day inkier printers, depending on the process, can have a resolution of better than 400 dpi. Without having to make up the dyeing liquor again it is thus possible to obtain a multiplicity of color intensities (color saturation levels).

The dyeing process of the invention can be carried out with any water-soluble, preferably anionic, dye, which preferably contains one or more sulfo and/or carboxy groups and may contain fiber-reactive groups. The dyes in question can belong not only to the class of the fiber-reactive dyes but also to the class of the azoic dyes, the class of the direct dyes, the class of the vat dyes or the class of the acid dyes, which can be for example azo dyes, copper complex, cobalt complex or chromium complex azo dyes, copper phthalocyanine or nickel phthalocyanine dyes, anthraquinone, copper formazan or triphendioxazine dyes. These dyes have been described in the literature in large numbers and are in every respect conversant to the person skilled in the art.

Of the abovementioned dyes usable for the dyeing process of the invention, the fiber-reactive dyes are used with preference. Fiber-reactive dyes are organic dyes which contain 1, 2, 3 or 4 fiber-reactive radicals of the aliphatic, aromatic or heterocyclic series. These dyes are described in the literature in large numbers. They can belong to a wide range of dye classes, for example the class of the monoazo, disazo, polyazo and metal complex azo dyes, such as 151 copper, 152 chromium and 1:2 cobalt complex monoazo and disazo dyes, and also the series of the anthraquinone dyes, copper and cobalt phthalocyanine dyes, copper formazan dyes, azomethine, nitroaryl, dioxazine, triphendioxazine, phenazine and stilbene dyes. Fiber-reactive dyes are dyes with a "fiber-reactive" group, i.e. a group capable of reacting with the hydroxy groups of the cellulose, the amino, carboxy, hydroxy or thiol groups of wool and silk or the amino and possibly carboxy groups of synthetic polyamides, to form a covalent chemical bond. The fiber-reactive radical can be bonded to the dye radical directly or via a bridge member; it is preferably bonded to the dye radical directly or via a possibly monoalkylated amino group, for example a group of the formula radical, such as methylene, ethylene, propylene or an alkylene radical of 2 to 8 carbon atoms which is interrupted by one or two oxy and/or amino groups, or via an amino-containing bridge member, for example via a phenylamino group.

Fiber-reactive radicals are for example: vinylsulfonyl, β-chloroethylsulfonyl, β-sulfatoethylsulfonyl, β-acetoxyethylsulfonyl, β-phosphatoethylsulfonyl, β-thiosulfatoethylsulfonyl, N-methyl-N-(-sulfatoethylsulfonyl)amino, acryloyl, —CO—CCl=$CH_2$, —CO—CH=CH—Cl, —CO—CCl=CHCl, —CO—CCl=CH—$CH_3$, —CO—CBr=$CH_2$, —CO—CH=CH—Br, —CO—CBr=CH—$CH_3$, —CO—CCl=CH—COOH, —CO—CH=CCl—COOH, —CO—CBr=CH—COOH, —CO—CCl=CCl—COOH, —CO—CBr=CBr—COOH, —CO—CH=CBr—COOH, β-chloro- or β-bromo-propionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonyl or -1-sulfonyl, β-(2,2,3,3-tetrafluorocyclobut-1-yl)acryloyl, α- or β-methylsulfonylacryloyl, propiolyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl, 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl, 2,4-dichlorotriazin-6-yl, 2,4-dichloropyrimidin-6-yl, 2,4,5-trichloropyrimidin-6-yl, 2,4-dichloro-5-nitro- or -5-methyl- or -5-carboxymethyl- or -5-carboxy- or -5-cyano- or -5-vinyl- or -5-sulfo- or -5-mono-, di- or -trichloromethyl- or -5-methylsulfonyl-pyrimidin-6-yl, 2,5-dichloro-4-methylsulfonylpyrimidin-6-yl, 2-fluoro-4-pyrimidinyl, 2,6-difluoro-4-pyrimidinyl, 2,6-difluoro-5-chloropyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro-4-pyrimidinyl, 2-fluoro-5-nitro-6-chloro-4-pyrimidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro-4-pyrimidinyl, 2,6-difluoro-5-bromo-4-pyrimidinyl, 2-fluoro-5-bromo-6-chloromethyl-4-pyrimidinyl, 2,6-difluoro-5-chloromethyl-4-pyrimidinyl, 2,6-difluoro-5-nitro-4-pyrimidinyl, 2-fluoro-6-methyl-4-pyrimidinyl, 2-fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl- or -5-methylsulfonyl-4-pyrimidinyl, 2-fluoro-5-carboxamido-4-pyrimidinyl, 2-fluoro-5-carbomethoxy-4-pyrimidinyl, 2-fluoro-5-bromo-6-trifluoromethyl-4-pyrimidinyl, 2-fluoro-6-carboxamido-4-pyrimidinyl, 2-fluoro-6-carbomethoxy-4-pyrimidinyl, 2-fluoro-6-phenyl-4-pyrimidinyl, 2-fluoro-6-cyano-4-pyrimidinyl, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl, 2,4-bis-(methylsulfonyl)-pyrimidin-4-yl, 2,5-bis(methylsulfonyl)-5-chloropyrimidin-4-yl, 2-methylsulfonylpyrimidin-4-yl, 2-phenylsulfonylpyrimidin-4-yl, 2-methylsulfonyl5-chloro-6-methylpyrimidin-4-yl, 2-methylsulfonyl-5-bromo-6-methylpyrimidin-4-yl, 2-methylsulfonyl-5-chloro-6-ethylpyrimidin-4-yl, 2-methylsulfonyl-5-chloro-6-methylpyrimidin-4-yl, 2-methylsulfonyl-5-nitro-6-methylpyrimidin-4-yl, 2,5,6-trismethylsulfonylpyrimidin-4-yl, 2-methylsulfonyl-5,6-dimethylpyrimidin-4-yl, 2-ethylsulfonyl-5-chloro-6-methylpyrimidin-4-yl, 2-methylsulfonyl-6-chloropyrimidin-4-yl, 2,6-bis(methylsulfonyl)-5-chloropyrimidin-4-yl, 2-methylsulfonyl-5-solfopyrimidin-4-yl, 2-methylsulfonyl-6-carbomethoxypyrimidin-4-yl, 2-methylsulfonyl-5-carboxypyrimidin-4-yl, 2-methylsulfonyl-5-cyano-6-methoxypyrimidin-4-yl, 2-methylsulfonyl-5-chloropyrimidin-4-yl, 2-sulfoethylsulfonyl-6-methylpyrimidin-4-yl, 2-methylsulfonyl-5-bromopyrimidin-4-yl, 2-phenylsulfonyl-5-chloropyrimidin-4-yl, 2-carboxymethylsulfonyl-5-chloro-6-methylpyrimidin-4-yl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine-5-carbonyl, or -5-sulfonyl, 2-methylsulfonyl-6-chloropyrimidin-4-yl and -5-carbonyl, 2,6-bis(methylsulfonyl)pyrimidin-4- or -5-carbonyl, 2-ethylsulfonyl-6-chloropyrimidine-5-carbonyl, 2,4-bis(methylsulfonyl)pyrimidine-5-sulfonyl, 2-methylsulfonyl-4-chloro-6-methylpyrimidine-5-sulfonyl or -5-carbonyl, 2-chloroquinoxaline-3-carbonyl, 2- or 3-monochloroquinoxaline-6-carbonyl, 2or 3-monochloroquinoxaline-6-sulfonyl, 2,3-dichloroquinoxaline-5- or -6-carbonyl, 2,3-dichloroquinoxaline-5- or -6-sulfonyl, 1,4-dichlorophthalazine-6-sulfonyl or -6-carbonyl, 2,4-dichloroquinazoline-7- or -6-sulfonyl or -carbonyl, 2,4,6-trichloroquinazoline-7- or -8-sulfonyl, 2- or 3- or 4-(4',5'-dichloropyridaz-6'-on-1'-yl)phenylsulfonyl or -carbonyl, β-(4',5'-dichloropyridaz-6'-on1'-yl)propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole-5- or -6-carbonyl or -5- or -6-sulfonyl, such as 2-methylsulfonyl or 2-ethylsulfonylbenzothiazole-5- or -6-sulfonyl or -carbonyl, 2-phenylsulfonylbenzothiazole-5- or-6-sulfonyl or -carbonyl and the corresponding 2-sulfonylbenzothiazole-5- or -6-carbonyl- or -sulfonyl derivatives with sulfo groups in the fused-on benzene ring, 2-chlorobenzoxazole-5- or -6-carbonyl or -sulfonyl, 2-chlorobenzimidzole-5- or -6-carbonyl or -sulfonyl, 2-chloro-1-methylbenzimidazole-5- or -6-carbonyl or -sulfonyl, 2-chloro-4-methylthiazole(1,3)-5-carbonyl or -4- or -5-sulfonyl, ammonium-containing triazine rings, such as 2-trimethylammonium-4-phenylamino- and -4-(o, m- or p-sulfophenyl)amino-6-triazinyl, 2-(1,1-dimethylhydrazinium)-4-phenylamino- and -4-(o-, m- or p-sulfophenyl)amino-6-triazinyl, 2-(2-isopropylidene-1,1-dimethyl)hydrazinium-4-phenylamino- and -4-(o-, m- or p-sulfophenyl)amino-6-triazinyl, 2-N-aminopyrrolidinium-, 2-N-aminopiperidinium-4-phenylamino- or -4-(o-, m- or p-sulfophenyl)amino-6-triazinyl, 4-phenylamino- or 4-(sulfophenylamino)-6-triazinyl which contains 1,4-bisazabicyclo[2.2.2]octane or 1,2-bisazabicyclo[0.3.3]octane bonded in quaternary fashion in the 2-position via a nitrogen bond, 2-pyridinium-4-phenylamino- or -4-(o-, m- or p-sulfophenyl)amino-6-triazinyl and corresponding 2-onium-6-triazinyl radicals which are substituted in the 4-position by alkylamino such as methylamino, ethylamino or β-hydroxyethylamino, or alkoxy, such as methoxy or ethoxy, or aryloxy, such as phenoxy or sulfophenoxy.

Particularly interesting fiber-reactive radicals are fluoro- and chloro-1,3,5-triazine radicals of the formula (16)

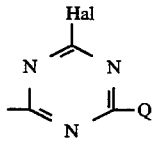

(16)

where Hal is chlorine or fluorine and Q is an amino, alkylamino, N,N-dialkylamino, cycloalkylamino, N,N-dicycloalkylamino, aralkylamino, arylamino, N-alkyl-N-cyclohexylamino or N-alkyl-N-arylamino group, or an amino group which contains a heterocyclic radical which can have a further fused-on carbocyclic ring or amino groups in which the aminonitrogen atom is part of an N-heterocyclic ring which may contain further hereto atoms, and also hydrazino and semicoarbozido groups, the alkyl radicals mentioned being straight-chain or branched and low molecular weight or high molecular weight and are preferably those having from 1 to 6 carbon atoms. Suitable cycloalkyl, aralkyl and aryl radicals are in particular cyclohexyl, benzyl, phenethyl, phenyl and naphthyl radicals; heterocyclic radicals are in particular furan, thiophene, pyrazole, pyridine, pyrimidine, quinoline, benzimidazole, benzothiazole and benzoxazole radicals. Suitable amino groups in which the aminonitrogen is part of a N-heterocyclic ring are preferably radicals of six-membered N-heterocyclic compounds which may contain nitrogen, oxygen or sulfur as further hereto atoms. The abovementioned alkyl, cycloalkyl, aralkyl and aryl radicals, the heterocyclic radicals and also the N-heterocyclic rings can be additionally substituted, for example by halogen, such as fluorine, chlorine or bromine, nitro, cyano, trifluoromethyl, sulfamoyl, carbamoyl, $C_1$–$C_4$-alkyl, $C_1$–$C_4$-alkoxy, acylamino groups, such as acetylamino or benzoylamino, ureido, hydroxy, carboxy, sulfomethyl or sulfo. Examples of such amino groups are —$NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, β-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloroanilino, anisidino, phenetidino, N-methyl-N-phenylamino, N-ethyl-N-phenylamino, N--hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfonaphth-1-ylamino, 3,6-disulfonaphth-1-ylamino, 3,6,8-trisulfonaphth-1-ylamino, 4,6,8-trisulfonaphth-1-ylamino, 1-sulfonaphth-2-ylamino, 1,5-disulfonaphth-2-ylamino, 6-sulfonaphth-2-ylamino, morpholino, piperidino, piperazino, hydrazino and semicarbazido.

Furthermore, Q can be an amino radical of the formula —$NR^{20}R^{21}$ in which $R^{20}$ is hydrogen or alkyl of 1 to 4 carbon atoms, such as methyl or ethyl, and $R^{21}$ is phenyl which is substituted by a fiber-reactive radical of the vinyl sulfone series directly or via a methylamino, ethylamino, methylene, ethylene or propylene group and which may be additionally substituted by 1 or 2 substituents selected from the group consisting of methoxy, ethoxy, methyl, ethyl, chlorine, carboxy and sulfo, or $R^{21}$ is alkyl of 2 to 4 carbon atoms, such as ethyl or n-propyl, which is substituted by a fiber-reactive group of the vinyl sulfone series, or alkylenephenyl having an alkylene radical of 1 to 4 carbon atoms whose phenyl is substituted by a fiber-reactive radical of the vinyl sulfone series, or in which $R^{20}$ and $R^{21}$ are each alkyl of 2 to 4 carbon atoms, such as ethyl or n-propyl, which are substituted by a fiber-reactive group of the vinyl sulfone series, or in which $R^{20}$ and $R^{21}$ are each alkylene of 3 to 8 carbon atoms which is interrupted by 1 or 2 oxy and/or amino groups and to which a fiber-reactive group of the vinyl sulfone series is bonded in the terminal position.

Fiber-reactive groups of the vinyl sulfone series are those of the formula —$SO_2$—Y in which Y is vinyl or is ethyl which is substituted in the β-position by an alkali-eliminable substituent, for example by chlorine, sulfato, phosphato, thiosulfato, acetyloxy, sulfobenzoyloxy or dimethylamino.

As already mentioned, the dyeings obtainable according to the invention on the modified cellulose fiber materials do not require any further aftertreatment after the fixation of the dye on the substrate, in particular no complicated aftertreatment process with a wash. If necessary at all, it is sufficient to rinse the dyed substrate one or more times with warm or hot and possibly cold water which may contain a nonionic wetting agent or a fiber-reactive aftertreating agent, for example condensation products of one mole of cyanuric chloride and two moles of 4-(β-sulfatoethylsulfonyl)aniline, of equivalent amounts of cyanuric chloride, 4-(β-sulfatoethylsulfonyl)aniline and 4,8-disulfo-2-aminonaphthalene or of equivalent amounts of cyanuric chloride, 4-sulfoaniline and 4,8-disulfo-2-aminonaphthalene. The use of a fiber-reactive aftertreating agent is advisable when the fiber material modified according to the invention was only dyed in a pale shade or with a dye which does not possess satisfactory fiber-reactivity. In these cases there are still sufficient dye-active sites present on the modified fiber, which are capable of reacting with other dyes in rinse baths contaminated with these dyes. The aftertreatment serves to deactivate the still active sites on the fiber modified according to the invention, and the originally desired clear dyeing is obtained even in the case of a dye-contaminated rinse water used in an industrial process. Furthermore, the dyed substrate does not require a final boil treatment with a washing solution for the purpose of improving the fastness properties.

The Examples which follow illustrate the invention. Parts and percentages are by weight, unless otherwise stated. Parts by weight bear the same relation to parts by volume as the kilogram to the liter.

EXAMPLE A

To synthesize an amino-containing compound usable according to the invention for modifying the fiber material, a mixture of 750 parts by volume of 100% strength sulfuric acid and 75 parts by volume of 20% strength oleum (i.e. sulfuric acid containing 20% of sulfur trioxide) at 10° C. is admixed with 500 parts by volume of N-(β-hydroxyethyl)piperidine, added gradually with stirring and constant cooling to maintain a reaction temperature between 20 and 25° C. After the reaction has ended, the reaction mixture is stirred into 1000 parts of ice-water, the batch is brought to pH 4 with calcium carbonate and then briefly heated to 50° C., and the resulting calcium sulfate is then filtered off. Any calcium ions still present are precipitated from the filtrate with sodium oxalate. After the calcium oxalate has been separated off, the aqueous solution of the N-(β-sulfatoethyl)piperidine is evaporated to dryness under reduced pressure. The yellow, oily product obtained forms crystals and melts at 124° C. with decomposition.

EXAMPLE B

To prepare a mixture of the compounds 3-sulfato-2-hydroxy-1-aminopropane and 2-sulfato-3-hydroxy-1-aminopropane, 92.9 parts of 2,3-dihydroxy-1-aminopropane are introduced with stirring into 98 parts of 96% strength sulfuric acid while the reaction temperature is maintained at 20 to 25° C. by external cooling. The workup of the reaction mixture and the isolation of the 3-sulfato-2-hydroxy-1-aminopropane are carried out in the same way as described in Example A.

EXAMPLE C 100 parts of 2,3-dihydroxy-1-(trimethylammonium)-propane chloride are slowly added with stirring at 20° C. to 110 parts of 100% strength sulfuric acid, the batch is subsequently stirred for some hours until the reaction has ended, and the ester compound formed is isolated in the manner indicated in Example A. The oily product obtained is a mixture of 3-sulfato-2-hydroxy-1-(trimethylammonium)propane sulfate and 2-sulfato-3-hydroxy-1-(trimethylammonium)propane sulfate.

EXAMPLE D

To prepare N-(γ-sulfato-β-hydroxypropyl)piperidine, 100 parts of N-(β,γ-dihydroxypropyl)piperidine are slowly stirred at 20° C. into 67 parts of 100% strength sulfuric acid. The batch is subsequently stirred for some hours and the piperidine compound of the invention is isolated in the manner described in Example A. Initially it is obtained as an oily product, which crystallizes over time. It melts at 170 to 175° C. with decomposition.

EXAMPLE E

To prepare N-(γ-sulfato-β-hydroxypropyl) pyrrolidine, 50 parts of N-(β,γ-dihydroxypropyl )pyrrolidine are slowly stirred at 20° C. into 98 parts of 100% strength sulfuric acid. The hatch is subsequently stirred for some hours and then the compound formed is isolated as an oily product in the manner indicated in Example A.

EXAMPLE F

To prepare a silane compound that is usable according to the invention, 67.9 parts of N-methylaminoethanol are slowly added to 35.2 parts of potassium in 1000 parts by volume of tetrahydrofuran while external cooling is applied to keep the exothermic reaction to a temperature between 30 and 40° C. The batch is then refluxed until all the potassium has reacted (about 5 hours). Then the batch is cooled down to about 20° C., and 190.3 parts of γ-chloropropyl(methyl)(diethoxy)silane are added while external cooling is applied, if necessary, to keep the reaction temperature to below 40° C. After the reaction has taken place, the precipitated potassium chloride is filtered off and the filtrate is freed of tetrahydrofuran by distillation. The product is then subjected to a vacuum distillation. The desired compound [γ-(β'-N-methylaminoethoxy)propyl]methyldiethoxysilane of the formula

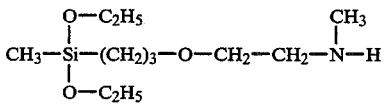

is separated off at $5\times10^{-2}$ mbar in a boiling range between 95 and 120° C.

EXAMPLE G

To prepare a silane compound that is usable according to the invention, Example A is repeated with the γ-chloropropylmethyldiethoxysilane being replaced by the equivalent amount of γ-chloropropyltriethoxysilane. The desired silane compound according to the invention [γ-(β'-N-methylaminoethoxy)propyl]triethoxysilane of the formula

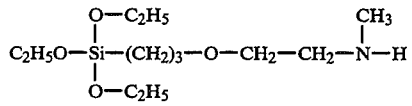

is isolated by fractional distillation at between 104 and 118° C. and $5\times10^{-2}$ mbar.

EXAMPLE H

To prepare a silane compound, Example A is repeated with the γ-chloropropylmethyldiethoxysilane being replaced by the equivalent amount of (γ-chloropropyl)(dimethyl)(ethoxy)silane. The desired compound according to the invention [γ-(β'-N-methylaminoethoxy)propyl](dimethyl)(ethoxy)silane of the formula

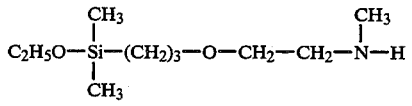

is isolated by fractional distillation at between 90 and 105° C. and $5\times10^{-2}$ mbar.

EXAMPLE J 36.7 parts of N-methylaminoethanol are slowly added to 20.1 parts of potassium in 700 parts by volume of tetrahydrofuran while external cooling is applied to keep the exothermic reaction to a temperature between 30 and 40° C. Then the batch is refluxed until all the potassium has reacted ( about 5 hours ) and thereafter 147.7 parts of a mixture (in the ratio of the meta/para isomers of about 70:30) of [3'- and 4'-chloromethylphenyl-1- and -2-ethyl ]methyldiethoxysilane are added at a temperature between 20 and 35° C. After the reaction has ended, the precipitated potassium chloride is filtered off and the filtrate is freed of tetrahydrofuran by distillation. The product is then subjected to a vacuum distillation. The compounds according to the invention, which conform to the formulae

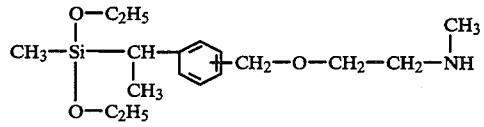

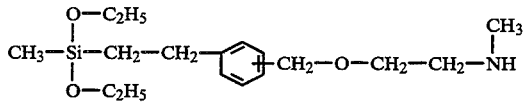

are separated off in a boiling range of between 165° C. and 200° C./10 mbar, the four individual compounds being collected in the following fractions:

1-{3'-[-(N-methylamino)ethoxymethyl]phenyl}eth-1yl(-diethoxy)(methyl)silane: condensation point: 165° C./10 mbar;

1-{4'-[-(N-methylamino)ethoxymethyl]phenyl}eth-1-yl(diethoxy)(methyl)silane: condensation point: 174° C./10 mbar;

2-{3'-[-(N-methylamino)ethoxymethyl]phenyl}eth-2-yl(diethoxy)(methyl)silane: condensation point: 185° C./10 mbar;

2-{4'-[-(N-methylamino)ethoxymethyl]phenyl}eth-2-yl(diethoxy)(methyl)silane: condensation point: 197° C./10 mbar;

EXAMPLE 1 a) A fabric made of mercerized and bleached cotton is impregnated with a 20°-25° C. aqueous solution of 50 parts of sodium hydroxide and 50 parts of 2-oxo-1,3-oxazolidine in 1000 parts of water to a liquor pickup of 75%. The material is then treated with hot air at 180° C. for 45 seconds, not only drying the fabric but also fixing the oxazolidinone compound to the fabric. The material is then treated in cold and 60° C. water and, if necessary, in an aqueous bath containing acetic acid until remaining alkali has been removed from the fabric.

b) The modified cotton fabric is passed by means of one or two guiding and tensioning rolls underneath an inkjet printer and printed with an aqueous 6% strength solution of the dye of the formula

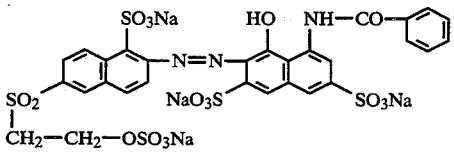

known from German Offenlegungsschrift No. 1,943,904 with a high dye solution add-on. The fabric thus printed is then steamed at 100° C. for 30 seconds, thereafter rinsed with cold and hot water in the presence or absence of a commercial wetting agent in the hot water, if necessary rinsed once more with cold water, and dried.

The result obtained with minimal liquor add-on and minimal wastewater pollution is a strong crisp red print which has good allround fastness properties, in particular good wash and light fastness properties.

EXAMPLE 2 a) A mercerized and bleached cotton fabric is impregnated at a temperature between 25 and 30° C. with an aqueous solution of 37.5 parts of sodium hydroxide and 75 parts of 2-oxo-1,3-oxazolidine in 1000 parts of water to a liquor pickup of 85% and then, to fix the oxazolidinone compound on the fiber material, treated with hot air at 150° C. for 2.5 minutes, drying the impregnated fabric at the same time. The modified material is then freed of excess alkali by treatment with cold and 60° C. water.

b) The modified, dried fabric is printed for example in a commercial office inkjet printer with water-soluble fiber-reactive dyes, the subtractive color mixing primaries (yellow, cyan, magenta and additionally black) being applied in one operation. Subsequent fixation is effected with a steamer at 105° C. and is followed by a hot wash.

EXAMPLE 3 a) A fabric made of mercerized and bleached cotton is impregnated with a 25°–30° C. aqueous solution of 80 parts of [γ-(β'-aminoethoxy)propyl]trimethoxysilane in 1000 parts of water, adjusted to pH 5.5 with glacial acetic acid, to a liquor pickup of 72%. The material is then dried with hot air at 130° C. for 5 minutes, fixing the silane compound on the material at the same time.

b) The dried cotton fabric thus modified is attached to a base and printed in a commercial office inkjet printer with aqueous solutions of fiber-reactive dyes by applying the subtractive color mixing primaries (yellow, cyan, magenta and additionally black) in succession in four individual passes. Subsequent fixation is effected using a steamer at 105° C. and followed by a hot wash.

c) To prepare an orange print it is possible to use for example the alkali metal salt of the dye of the formula

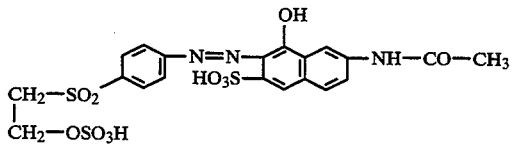

known from European Patent Application Publication No. 0 061 151. A crisp pattern is obtained with minimal dye solution add-on and without wastewater. Fixation of the dye in a steamer gives fast orange dyeings.

EXAMPLE 4 a) A mercerized and bleached cotton fabric is padded with an aqueous solution of 50 parts of [γ- (β'-aminoethylamino)propyl]trimethoxysilane in 1000 parts of water, adjusted to pH 5.5 with glacial acetic acid, at 25 to 30° C. to a liquor pickup of 72%. Thereafter the silane compound is fixed on the cotton and the padded fabric dried at the same time by treating it with hot air at 130° C. for about 5 minutes.

b) The dried cotton fabric thus modified is printed on a flatbed printer, with exclusive movement of the printing head, in one operation with a fiber-reactive dye as for example one of the dyes described in the preceding or subsequent examples. The printed material is then treated with dry heat to fix the dye and, if necessary, subsequently washed cold.

EXAMPLE 5 a) A mercerized and bleached cotton fabric is padded with an aqueous solution of 50 parts of [γ-(β'-aminoethylamino)propyl]trimethoxysilane in 1000 parts of water, adjusted to pH 5.5 with glacial acetic acid, at 25 to 30° C. to a liquor pickup of 72%. Thereafter the silane compound is fixed on the cotton and the padded fabric dried at he same time by treating it with hot air at 130° C. for about 5 minutes.

b) The cotton fabric thus modified is directly pulled into an inkier printer by means of one or two rubber rolls and printed in one operation with fiber-reactive dyes in the primary colors of subtractive color mixing. The subsequent fixation can be effected for example by microwave irradiation. The dyes do become fixed fast on the material, so that in general there does not appear to be any need for an afterwash.

EXAMPLE 6 a) A fabric made of commercial acrylic fiber is padded to a liquor pickup of 84%, on weight of fiber, with an aqueous solution of 50 parts of [β-(γ'-aminopropylamino)ethyl]trimethoxysilane in 1000 parts of water, which has been adjusted to pH 5.5 with glacial acetic acid. The padded fabric is then exposed to a temperature of 100° C. for 5 minutes, not only fixing the silane compound on the material but also drying the material.

b) The fabric thus modified is printed in a commercial inkier printer using an aqueous solution of a black reactive dye and aqueous solutions of fiber-reactive dyes whose primary colors yellow, cyan and magenta correspond to a subtractive color mix. The dyes are then fixed in a steamer at 130° C. No afterwash is necessary.

c) To prepare a brilliant red, crisp print, procedure b) can be employed to apply by means of a commercial inkier printer merely the aqueous solution of the dye of the formula

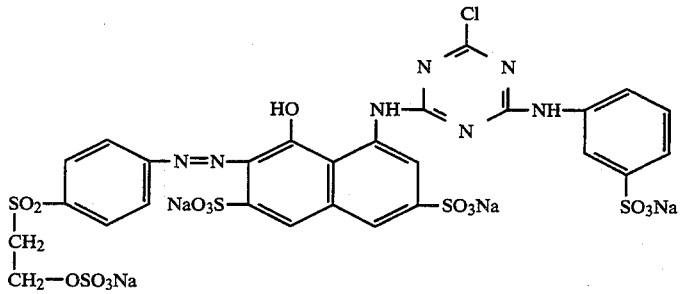

known from Example 1 of European Patent No. 0 032 187. The print obtained is wash-fast and has crisp contours.

a) A fabric made of commercial pure silk is impregnated with the silane solution specified in Example 3 to a liquor pickup of 80% and then dried at 120° C. for 3 minutes, which also serves to fix the silane compound on the silk fiber.

b) The material thus modified is attached to a base and printed in a commercial office inkjet printer with aqueous dye solutions, the primaries of subtractive color mixing (yellow, cyan, magenta and additionally black) being applied in succession in four individual passes. The dyes are then fixed on the material at 105° C. by means of a steamer. The material bearing the crisp print is then afterwashed hot.

EXAMPLE 8 a) A fabric made of mercerized and bleached cotton is impregnated with a 20 to 25° C. aqueous solution of 50 parts of sodium hydroxide and 50 parts of 1-N-(β-sulfatoethyl)piperazine in 1000 parts of water to a liquor pickup of 90%. The material is then treated with hot air at 150° C. for 2.5 min, not only drying the material but also fixing the piperazine compound to the material. The material thus obtained is then treated in cold and 60° C. water and if necessary in an aqueous bath which contains acetic acid until remaining alkali has been removed from the fabric.

b) The modified cotton fabric is printed in a commercial inkier printer with an aqueous solution of an alkali metal salt of the dye of the formula

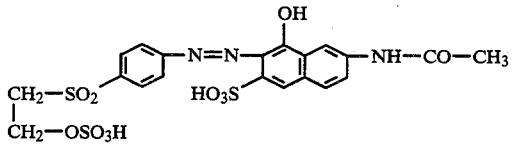

known from European Patent Application Publication No. 0 161 151. Fixation is effected in a steamer at 130° C. No afterwash is necessary. The print obtained has an orange color, crisp contours and good fastness properties.

EXAMPLE 9 a) A fabric made of mercerized and bleached cotton is padded with a 20 to 25° C. aqueous solution of 50 parts of sodium hydroxide and 50 parts of the monosulfate of 2,3-dihydroxy-1-aminopropane in 1000 parts of water to a liquor pickup of 90%. The impregnated material is then treated with hot air at 150° C. for 2.5 minutes to fix the aminopropane compound to the material and at the same time dry the material and then washed in cold and 60° C. water to effect complete removal of the excess alkali, and thereafter dried.

b) The fabric thus modified is printed in a desired pattern in a commercial office inkier printer with the aqueous solution of the dye of the formula

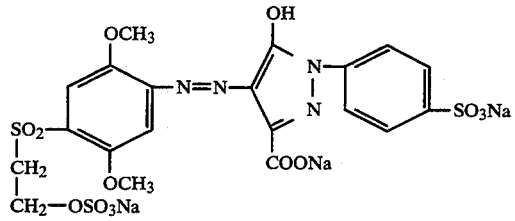

known from European Patent No. 158 233. The dye is then fixed by means of dry heat at 120° C. The print obtained has crisp contours and a strong yellow color (if the dye solution is applied by the inkjet printer uniformly, a strong, level yellow dyeing is obtained) having the usual good fastness properties.

EXAMPLE 10

A mercerized and bleached cotton fabric is impregnated with an aqueous solution of 50 parts of sodium hydroxide and 100 parts of the monosulfate 2,3-dihydroxy-1-aminopropane in 1000 parts of water at a temperature between and 30° C. to a liquor pickup of 85% and then treated with hot air at 150° C. for about 3 minutes to fix the aminopropane compound on the fiber material and at the same time dry the impregnated fiber material. The modified material is then freed of excess alkali by treating it with cold and 60° C. water.

The dried material thus modified is guided by means of a rubber roll underneath a stainless steel sheet and printed in one operation with the aqueous solutions of fiber-reactive dyes in the primary colors of subtractive color mixing using a drop-on-demand inkjet printing head. The cloth is then passed through a continuous microwave dryer for fixation. The dyed material can then be finished by washing; in general, however, a short, hot wash and subsequent drying is sufficient.

EXAMPLE 11 a) A fabric made of mercerized and bleached cotton is impregnated with a 20 to 25° C. aqueous solution of 50 parts of sodium hydroxide and 32 parts of 1-N-(β-sulfatoethyl )piperazine in 1000 parts of water to a liquor pickup of 90%, based on the weight of the fabric, in a commercial pad-mangle.

The padded fabric is then dried; the fixation of the piperazine compound on the fabric is effected by means of a heat treatment at 180° C. The fabric is then rinsed in cold and about 60° C. water until remaining alkali has been removed from the fabric.

b) The fabric modified as per a) is stretched over a roll in a commercial continuous-flow inkier printer. As the roll rotates, aqueous solutions of four dyes are applied by the four-color printing technique to produce a colored image (the ejection of the dye solutions can be controlled in the inkier printer for example by means of a computer program). After printing has ended, the fabric is steamed at 105° C. for 15 minutes; it is then aftertreated in a hot, soap-containing washing bath with subsequent rinsing with hot and cold water. To prevent staining of the ground, small amounts of ammonia or diethanolamine can be added to the washing bath. Suitable four-color printing dyes are for example the following: as the cyan component the copper phthalocyanine dye known from Example 2 of DE-A-1 179 317, as the yellow component the dye known from Example 56 of German Auslegeschrift 2,634,909, as the magenta component the red dye known from Example 3 of EP-A-0 158 233 and as the black component the black dye known from the table in columns 17/18 of German Auslegeschrift 1,544,538.

The fabric obtained shows a very crisp color print of the selected pattern; the dyeing itself has good wash fastness.

EXAMPLE 12 a) A viscose fabric is impregnated in a commercial pad-mangle with a 20 to 25° C. aqueous solution of 50 parts of sodium hydroxide and 32 parts of 1-N-(β-sulfatoethyl)piperazine in 1000 parts of water to a liquor pickup of 90%, based on the weight of the fabric. The fabric is then dried and subjected to a heat treatment at 180° C. for about 45 seconds, which also serves to fix the piperazine compound on the fabric. This is followed by an aftertreatment in cold and about 60° C. water until remaining alkali has been removed from the fabric.

b) After the modified fabric obtained under a) has been dried it is printed with a four-color print as described in Example 11 b) in the commercial inkjet printer mentioned there, the four dye components being for example the following: as the cyan component the copper phthalocyanine dye known from Example 2 of DE-A-1 179 317, the yellow dye (22) known from U.S. Pat. No. 3,926,944, as the magenta component the red dye known from Example 15 of German Auslegeschrift 1,126,647, and C.I. Reactive Black 5 known from the Colour Index.

The fabric obtained shows a very crisp color print in the chosen pattern; the dyeing itself has good wash fastness.

EXAMPLE 13 a) A cotton twill (gray-state ecru, weight 200 g/kg) is impregnated with an aqueous liquor containing 60 parts of 1-N-(β-sulfatoethyl)piperazine, 100 parts of sodium hydroxide, 5 parts of a commercial non-ionic wetting and washing agent and 6 parts of a commercial agent for stabilizing the liquor and for preserving the fiber, in 1000 parts of water, to a liquor take-off of 100%. The impregnated fabric is wound onto a batch roller and subjected to a temperature between 95 and 103° C. for 60 minutes. This is followed by an aftertreatment of the fabric in boiling water to which a commercial surfactant may have been added to remove water-soluble impurities present on the fabric. After further rinsing with hot and cold water and drying, the textile fabric obtained exhibits a degree of desizing of 9 (evaluated according to Tegewa) and a wicking height of 6.5 cm/30 min.

b) The cotton fabric modified as per a) is clamped into a piezo inkjet printer. Using a computer a color image is printed with solutions of three dyes by the three-color printing technique, using as dyes for example the following ones: the blue dye known from Example 56 of German Auslegeschrift 2,634,909, the yellow dye (22) known from U.S. Pat. No. 3,926,944, and as the magenta component the red dye known from Example 1 of EP-A-0 022 575. After printing, the dyes are fixed on the fabric by steaming at 105° C. for 15 minutes, and the fabric is then washed in a hot, soap-containing washing bath and thereafter rinsed with hot and cold water. To prevent staining of the white ground, small amounts of ammonia or diethanolamine can be added to the washing bath.

EXAMPLES 14 to 44

To prepare further dyeings by the process of the invention, the starting material employed is a cellulose fiber material which has been modified according to the invention, for example a cellulose fiber material as modified in the above Embodiment Examples, the material is printed using an inkier printer, for example by one of the methods described in the above Embodiment Examples, using aqueous solutions of one or more of the known dyes indicated below in the Table Examples (the dyes are written in the form of the free acid; however, they are used in the form of their alkali metal salts). Clear, strong prints are obtained in the hue indicated for the respective Table Example and with the good fastness properties of the respective dye, in particular good wash fastness properties.

| Ex. | Dye used (in the form of an alkali metal salt) | Hue |
|---|---|---|
| 14 | 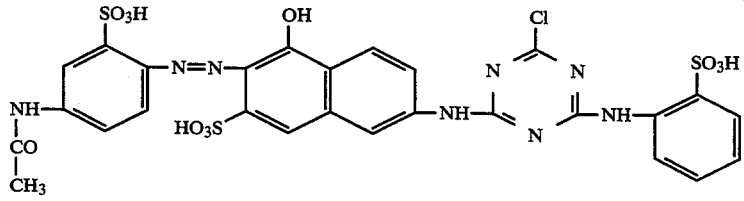 (known from CH Patent 350,390) | Scarlet |

-continued
| Ex. | Dye used (in the form of an alkali metal salt) | Hue |
|---|---|---|
| 15 | 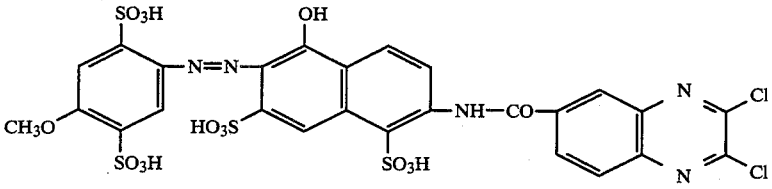 (known from DE-A-1 813 438, Ex. 1) | Scarlet |
| 16 | 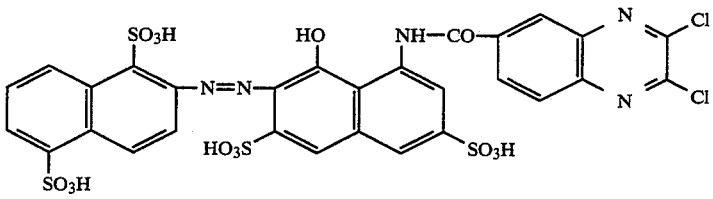 (known from German Auslegeschrift 1,191,059) | Red |
| 17 | 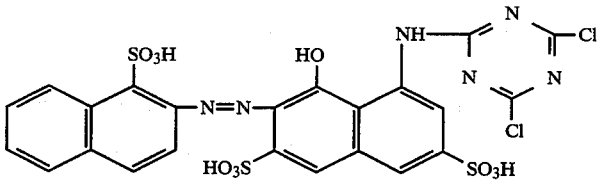 (known from German Auslegeschrift 1,088,633) | Red |
| 18 | 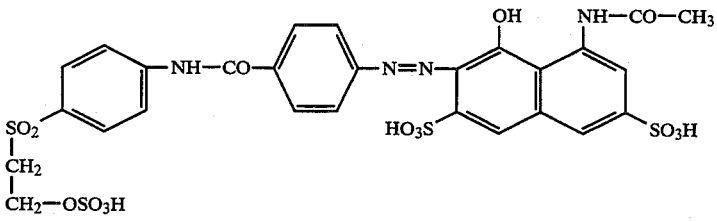 (known from German Auslegeschrift 1,126,647) | Red |
| 19 | 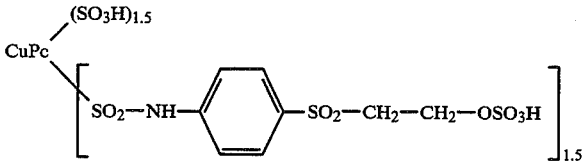 CuPc = copper phthalocyanine (known from DE-A-1 179 317, Ex. 2) | Turquoise |
| 20 | 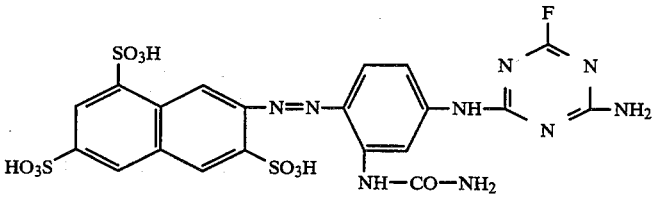 (known from DE-A-2 840 380) | Yellow |
| 21 | 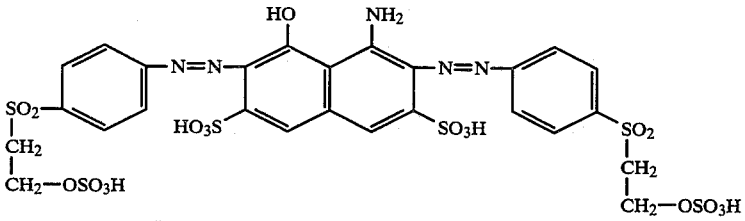 (known from Colour Index as C.I. Reactive Black 5) | Navy |

-continued
| Ex. | Dye used (in the form of an alkali metal salt) | Hue |
|---|---|---|
| 22 | 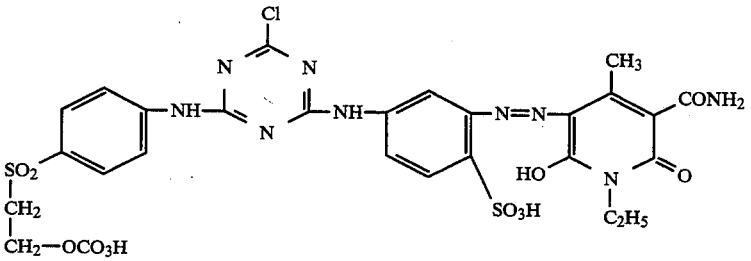 (known from U.S. Pat. No. 3,926,944) | Yellow |
| 23 | 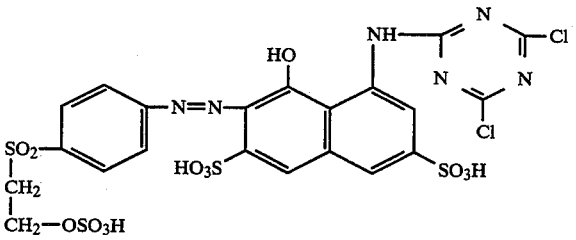 (known from JP-B sho-63-23287) | Red |
| 24 | 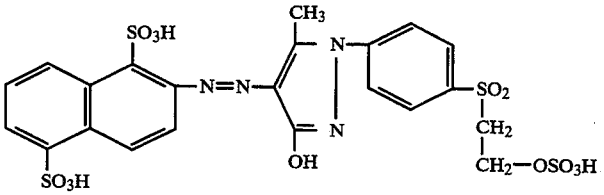 (known from German Auslegeschrift 2,634,909) | Yellow |
| 25 | 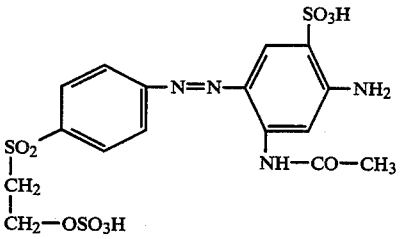 (known from EP Patent 0 073 481) | Yellow |
| 26 | 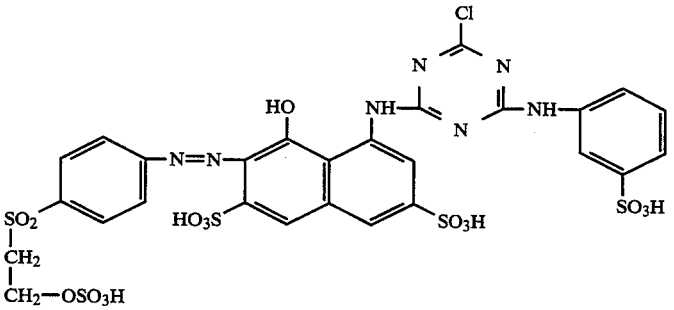 (known from EP Patent 0 032 187) | Red |

-continued
| Ex. | Dye used (in the form of an alkali metal salt) | Hue |
|---|---|---|
| 27 | 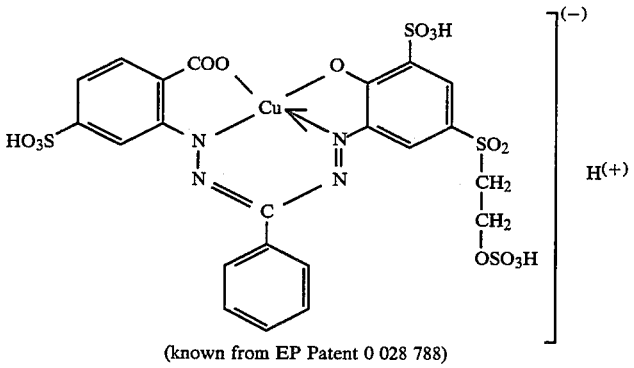 (known from EP Patent 0 028 788) | Blue |
| 28 | 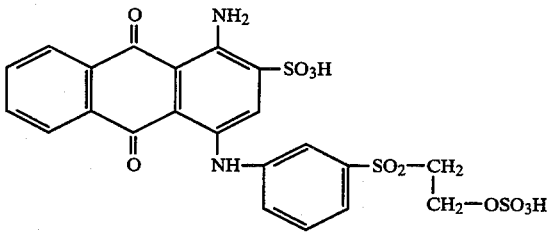 (known from Colour Index as C.I. Reactive Blue 19) | Blue |
| 29 | 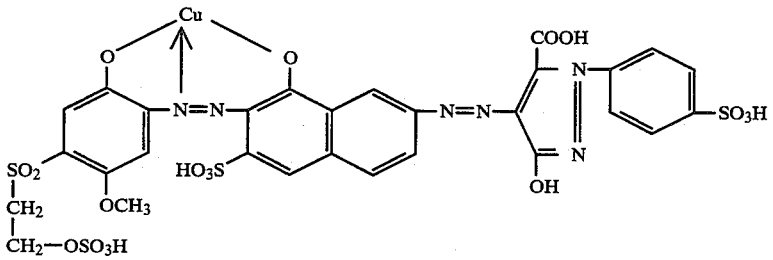 (known from German Auslegeschriften 1,544,538 and 1,544,555) | Black |
| 30 | 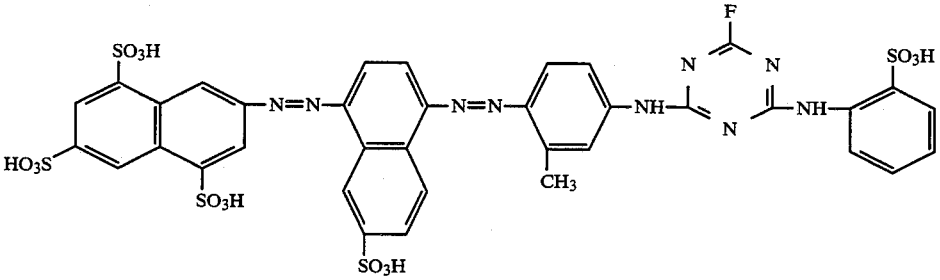 (known from DE-A-2 733 109, Ex. 2) | Reddish brown |

-continued
| Ex. | Dye used (in the form of an alkali metal salt) | Hue |
|---|---|---|
| 31 | 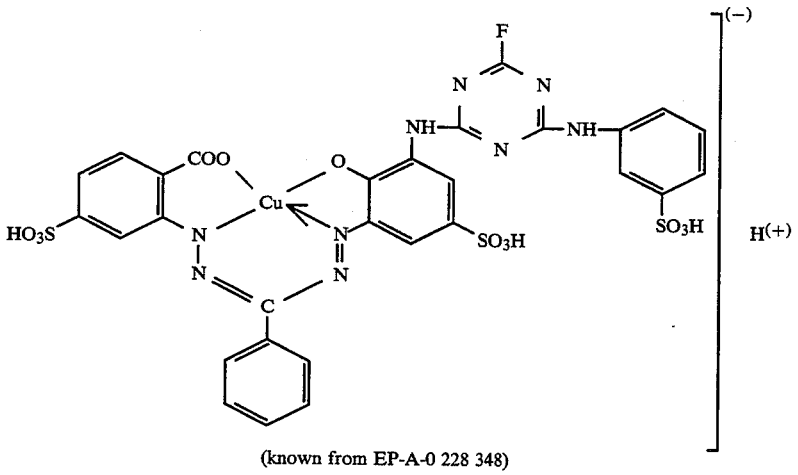 (known from EP-A-0 228 348) | Blue |
| 32 | 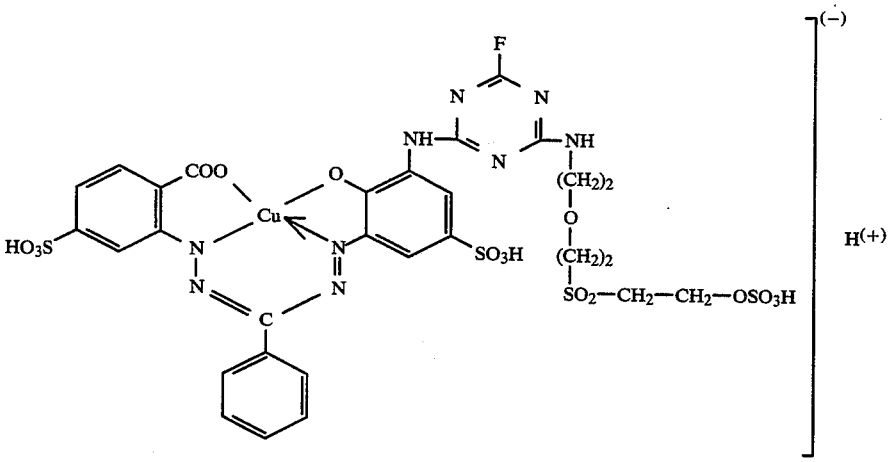 (known from EP-A-0 144 766) | Blue |
| 33 | 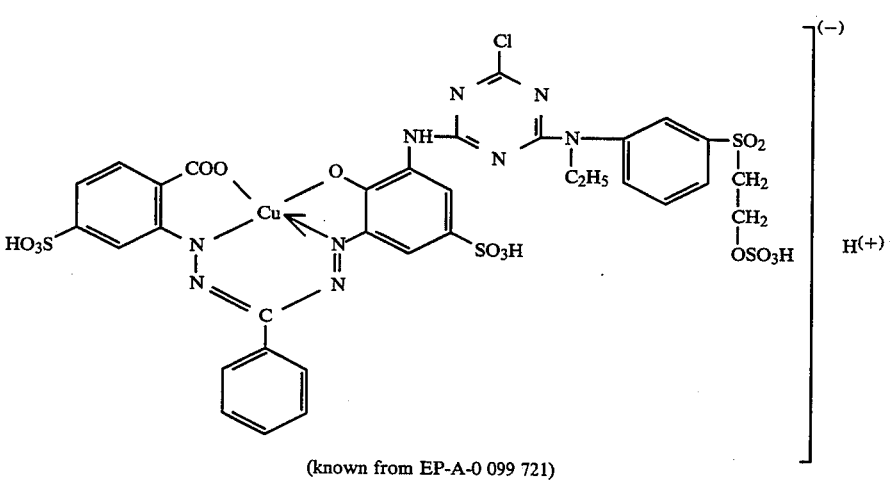 (known from EP-A-0 099 721) | Blue |
| 34 | | Blue |

-continued
| Ex. | Dye used (in the form of an alkali metal salt) | Hue |
|---|---|---|
| | 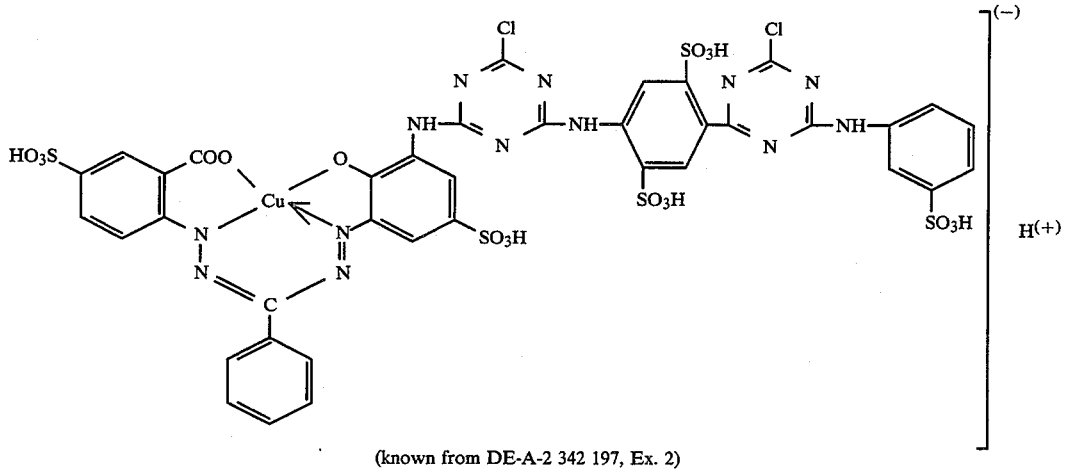 (known from DE-A-2 342 197, Ex. 2) | H(+) |
| 35 | 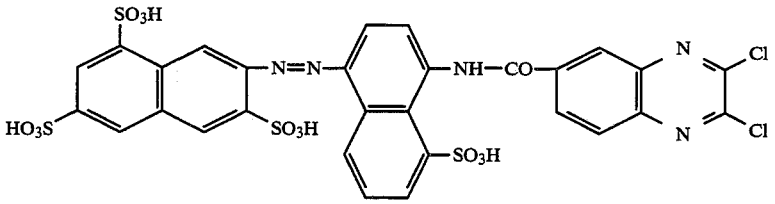 (known from German Auslegeschrift 1,191,059) | Yellow |
| 36 | 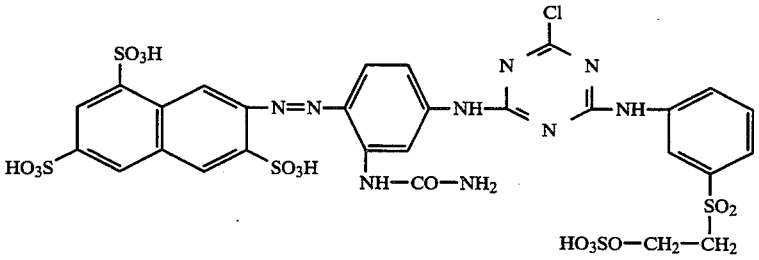 (known from European Patent Application Publication No. 0 056 975) | Yellow |
| 37 | 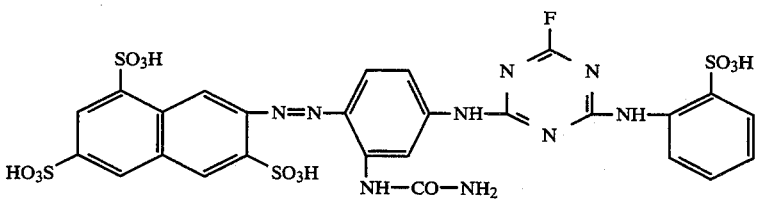 (known from DE-A-2 657 341) | Yellow |
| 38 | 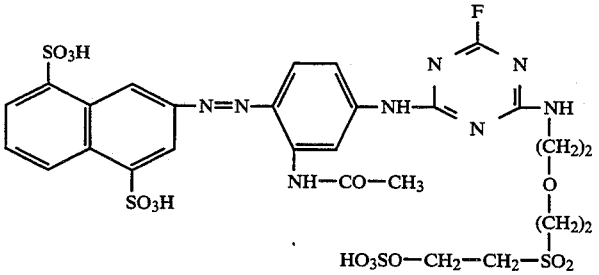 (known from EP-A-0 457 715) | Yellow |

-continued
| Ex. | Dye used (in the form of an alkali metal salt) | Hue |
|---|---|---|
| 39 | 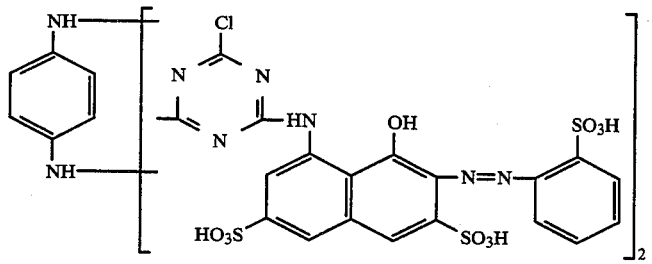 (known from DE-A-2 001 960) | Red |
| 40 | 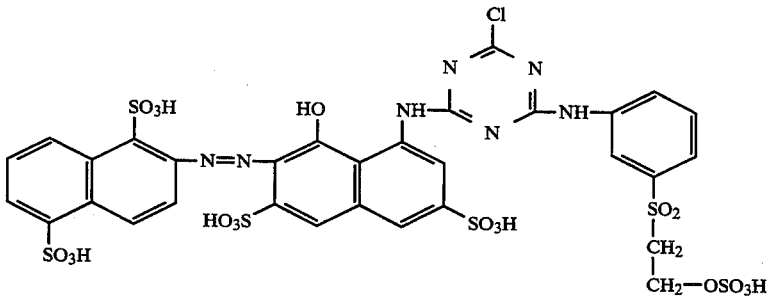 (known from EP-A-0 022 575) | Red |
| 41 | 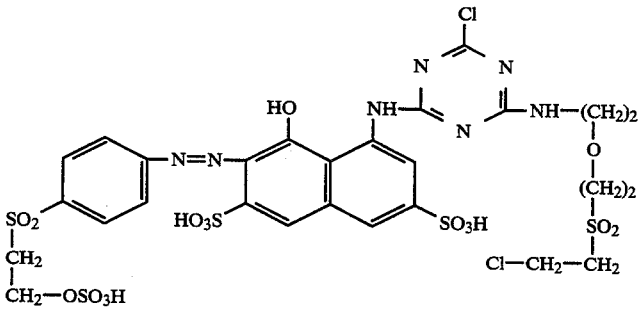 (known from EP-A-0 144 766, Ex. 5) | Red |
| 42 | 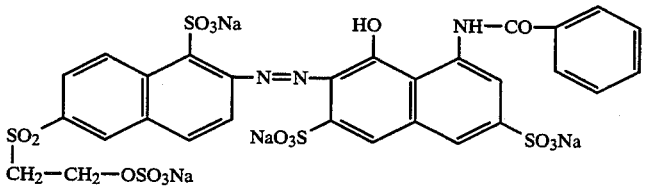 (known from EP-A-0 158 233, Ex. 3) | Red |
| 43 | 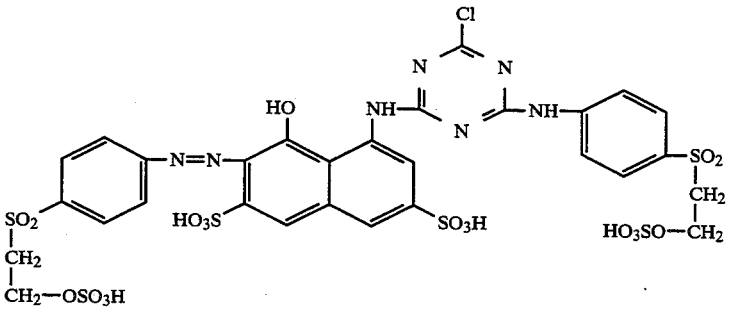 (known from EP Patent 0 094 055) | Red |
| 44 | | Red |

-continued

| Ex. | Dye used (in the form of an alkali metal salt) | Hue |
|---|---|---|
| | 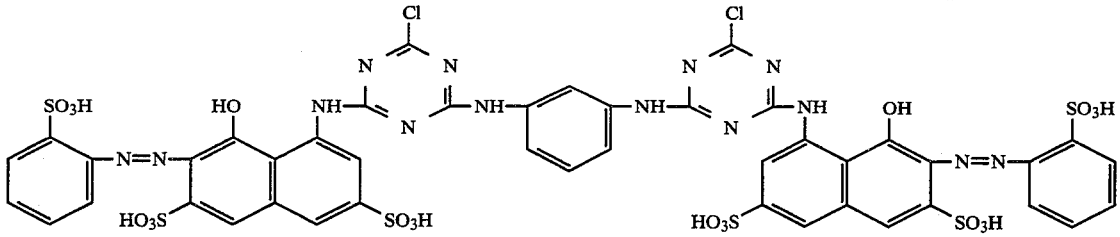 (known from DE-A-2 001 960) | |

What is claimed is:

1. A process for dyeing a sheetlike fiber material with anionic dyes, which comprises applying an alkali-free aqueous solution of the anionic dye by the inkjet printing spray technique to a fiber material which has been pretreated and modified with a compound that contains one or more primary, secondary or tertiary amino groups or quaternary ammonium groups, which amino or ammonium groups are optionally part of a heterocycle.

2. The process of claim 1, wherein the sheetlike fiber material is made of or containing cellulose fibers.

3. The process of claim 1, wherein the anionic dye has a fibre-reactive group.

4. The process of claim 1, wherein the alkali-free solution of the anionic dye is low-electrolyte or completely electrolyte-free.

5. The process of claim 1, wherein the compound with which the fiber material was pretreated and modified is a compound of the formula (1) or (2)

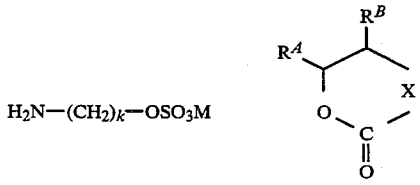

(1) (2)

where

M is a hydrogen or an alkali metal, k is 1 or 2, $R^A$ is hydrogen or alkyl of 1 to 3 carbon atoms which are optionally substituted by hydroxy or a group of the formula (5a) or (5b)

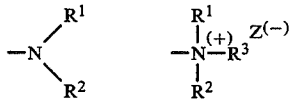

(5a) (5b)

where $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed from an alkylene of up to 8 carbon atoms or two alkylenes of 1 to 4 carbon atoms and an oxygen atom or an amino group of the formula —NH—, and $Z^{(-)}$ is an anion, $R^B$ has one of the meanings specified for $R^A$, and X is —O— or —NH—, 6. The process of claim 1, wherein the compound with which the fiber material was pretreated and modified is a compound of the formula (3a) or (3b)

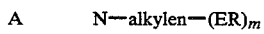

(3a)

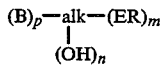

(3b)

where

ER is an ester group,

A and N together with 1 or 2 alkylene groups of 1 to 4 carbon atoms form the bivalent radical of a heterocyclic ring in which A is an oxygen atom or a group of the formula

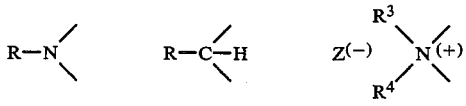

(a) (b) (c)

where

R is a hydrogen atom, an amino group, an alkyl group of 1 to 6 carbon atoms which may be substituted by 1 or 2 substituents selected from the group consisting of amino, sulfo, hydroxy , sulfato, phosphato and carboxy, or an alkyl group of 3 to 8 carbon atoms which is interrupted by 1 or 2 hereto groups selected from —O— and —NH— and are optionally substituted by an amino, sulfo, hydroxy, sulfato or carboxy group, $R^3$ is hydrogen, methyl or ethyl, $R^4$ is hydrogen, methyl or ethyl, and $Z^{(-)}$ is an anion, B is an amino group of the formula $H_2N$— or an amino or ammonium group of the formula (d) or (e)

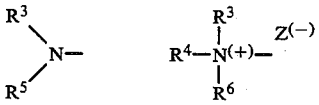

(d) (e)

in which $R^3$, $R^4$ and $Z^{(-)}$ are each as defined above, $R^5$ is methyl or ethyl, and $R^6$ is hydrogen, methyl or ethyl, p is 1 or 2, alkylen is a straight-chain or branched alkylene of 2 to 6 carbon atoms which are optionally substituted by 1 or 2 hydroxy groups, or a straight-chain or branched alkylene of 3 to 8 carbon atoms which is interrupted by 1 or 2 hereto groups selected from —O— and —NH—, alk is a straight-chain or branched alkylene or 2 to 6 carbon atoms or a straight chain or branched alkylene of 3 to 8 carbon atoms which is interrupted by 1 or 2 hetero groups selected from —O— and —NH—, m is 1 or 2, n is from 1 to 4, and the amino, hydroxy and ester groups can be attached to a primary, secondary or tertiary carbon atom of the alkylene radical.

7. The process of claim 1, wherein the compound with which the fiber material was pretreated and modified is a compound of the formula (4 )

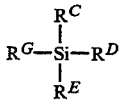

(4)

where $R^C$ is hydrogen, alkoxy of 1 to 8 carbon atoms, halogen, hydroxy, alkoxy of 2 to 4 carbon atoms with alkoxy of 1 to 4 carbon atoms as substituent, N-morpholino, N-imidazolino or a group of the formula (6)

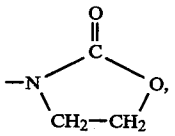

(6)

$R^D$ is a group of the formula (7a) or (7b)

$$\left[D-X^1\right]_a\left\{\left[E-X^2\right]_b G-T\right\}_c \quad (7a)$$

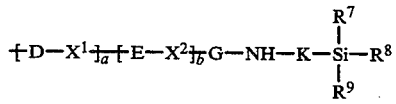

(7b)

where a is zero or 1, b is an integer from zero to 10, c is 1 or 2, c=1 being mandatory when a is zero, $R^7$ has one of the meanings of $R^C$, $R^8$ is alkoxy of 1 to 8 carbon atoms with or without alkoxy of 1 to 4 carbon atoms as substituent, alkyl of 1 to 8 carbon atoms, alkenyl of 2 to 8 carbon atoms or phenylene-alkyl where the alkyl radical has 1 to 4 carbon atoms and the phenylene radical is optionally substituted by substituents selected from the group consisting of methyl, ethyl, methoxy, ethoxy, sulfo and carboxy, each of which radicals $R^8$ is optionally additionally substituted by a group T o f the above meaning, $R^9$ has one of the meanings of $R^C$ or $R^E$, D is alkylene of 1 to 6 carbon atoms which may be substituted by hydroxy, methoxy, ethoxy, sulfo, sulfato or carboxy, or is phenylene unsubstituted or substituted by substituents selected from methoxy, ethoxy, methyl, ethyl, sulfo and carboxy, or is phenylenealkylene, alkylenephenylene, alkylenephenylenealkylene, or phenylenealkylene phenylene, in each of which the alkylene group or groups has or have from 1 to 6 carbon atoms and may be substituted by hydroxy, methoxy, ethoxy, sulfo, sulfato, or carboxy and the phenylene radicals are unsubstituted or substituted by substituents selected from methoxy, ethoxy, methyl, ethyl, sulfo and carboxy, $X^1$ is for c=1 a group of the formula —S—, —O—, —NH— or —N(R)—, R being alkyl of 1 to 4 carbon atoms, or for c=2 is a nitrogen atom, E is cycloalkylene of 5 to 8 carbon atoms or alkylene of 1 to 6 carbon atoms which may be substituted by hydroxy, methoxy, ethoxy, sulfato, sulfo or carboxy, or is phenylene unsubstituted or substituted by substituents selected from methoxy, ethoxy, methyl, ethyl, sulfo and carboxy, $X^2$ is a group of the formula —S—, —O—,—NH—or —N(R)— where R is as defined above, G is alkylene of 1 to 6 carbon atoms which is optionally substituted by hydroxy, methoxy, ethoxy, sulfo, sulfato or carboxy, or is phenylene unsubstituted or substituted by substituents selected from methoxy, ethoxy, methyl, ethyl, sulfo and carboxy, or is phenylenealkylene, alkylenephenylene, alkylenephenylenealkylene or phenylenealkylenephenylene, in each of which the alkyl group or groups has or have from 1 to 6 carbon atoms and is optionally substituted by hydroxy, methoxy, ethoxy, sulfo, sulfato or carboxy and the phenylene radical or radicals are unsubstituted or substituted by substituents selected from methoxy, ethoxy, methyl, ethyl, sulfo and carboxy, or G can be a direct bond if (a+b) is not zero, T is hydroxy, thiol or a group of the formula (8a) or (8b)

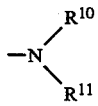

(8a)

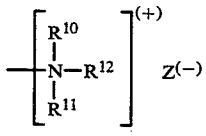

(8b)

where $R^{10}$ is hydrogen or alkyl of 1 to 4 carbon atoms which is optionally substituted by phenyl, sulfophenyl, amino, thio or hydroxy, $R^{11}$ is hydrogen, phenyl, sulfophenyl or alkyl of 1 to 4 carbon atoms which is optionally substituted by phenyl, sulfophenyl, methoxy, ethoxy, amino, thio or hydroxy, $R^{12}$ is hydrogen, alkyl of 1 to 4 carbon atoms which is optionally substituted, or alkenyl of 2 to 6 carbon atoms, and $Z^{(-)}$ is an anion, K is a radical of the formula (9)

$$-G\left[X^2-E\right]_b\left[X^1-D\right]_a \quad (9)$$

where G, $X^2$, E, $X^1$, D, a and b are each as defined above, $R^E$ is hydrogen, alkoxy of 1 to 8 carbon atoms with or without alkoxy of 1 to 4 carbon atoms as substituent, halogen, hydroxyl, alkyl of 1 to 8 carbon atoms, alkenyl of 2 to 8 carbon atoms, alkinyl of 3 to 8 carbon atoms or phenyl or a group of the formula (7a) or (7b), $R^G$ has one of the meanings mentioned for $R^c$ or $R^E$, and at least one of the substituents attached to the silicon atom is a hydrolyzable substituent selected from the group consisting of hydrogen, halogen, alkoxy, phenoxy, amino and amido.

8. A sheetlike fiber material dyed as claimed in claim 1.

* * * * *

UNITED STATES PATENT AND TRADEMARK OFFICE

CERTIFICATE OF CORRECTION

PATENT NO. : 5,348,557

DATED : September 20, 1994

INVENTOR(S) : von der Eltz et al

It is certified that error appears in the above-indentified patent and that said Letters Patent is hereby corrected as shown below:

In column 2, line 17 formula (3a) should read:

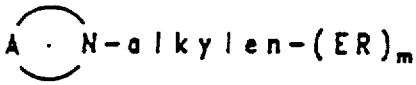

(3a)

In claim 6, col. 40, line 23, formula (3a) should read:

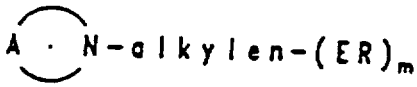

(3a)

Col. 40, line 50, "hereto" should read -- hetero --.

UNITED STATES PATENT AND TRADEMARK OFFICE

CERTIFICATE OF CORRECTION

PATENT NO. : 5,348,557

DATED : September 20, 1994

INVENTOR(S) : von der Eltz et al

It is certified that error appears in the above-indentified patent and that said Letters Patent is hereby corrected as shown below:

Col. 41, line 9, "hereto" should read -- hetero --.

Signed and Sealed this

Seventeenth Day of January, 1995

*Attest:*

Bruce Lehman

BRUCE LEHMAN

*Attesting Officer*

*Commissioner of Patents and Trademarks*